US006386860B1

(12) United States Patent
Adams et al.

(10) Patent No.: US 6,386,860 B1
(45) Date of Patent: May 14, 2002

(54) CHILD RESISTANT LIGHTER

(75) Inventors: Paul Adams, Monroe; Richard M. Orazietti, Derby; Floyd Fairbanks, Naugatuck, all of CT (US)

(73) Assignee: BIC Corporation, Milford, CT (US)

( * ) Notice: Subject to any disclaimer, the term of this patent is extended or adjusted under 35 U.S.C. 154(b) by 0 days.

(21) Appl. No.: 09/377,811

(22) Filed: Aug. 20, 1999

Related U.S. Application Data

(63) Continuation-in-part of application No. 09/172,609, filed on Oct. 15, 1998.

(51) Int. Cl.[7] ..... F23Q 2/28
(52) U.S. Cl. ..... 431/153; 431/255
(58) Field of Search ..... 431/153, 255

(56) References Cited

U.S. PATENT DOCUMENTS

| | | | |
|---|---|---|---|
| 3,734,680 | A | 5/1973 | Maruyama |
| 3,891,381 | A | 6/1975 | Moriya |
| 3,898,031 | A | 8/1975 | Rusakowicz |
| 4,457,697 | A | 7/1984 | Kitabayashi |
| 4,758,152 | A | 7/1988 | Kordecki |
| 4,784,601 | A | 11/1988 | Nitta |
| 4,784,602 | A | 11/1988 | Nitta |
| 4,786,248 | A | 11/1988 | Nitta |
| 4,799,877 | A | 1/1989 | Bisbee |
| 4,830,603 | A | 5/1989 | Cirami |
| 4,832,596 | A | 5/1989 | Morris, Sr. |
| 4,859,172 | A | 8/1989 | Nitta |
| 4,904,180 | A | 2/1990 | Nitta |

(List continued on next page.)

FOREIGN PATENT DOCUMENTS

| | | | | |
|---|---|---|---|---|
| JP | 4-186018 | * | 7/1992 | ..... 43/255 |
| TW | 207783 | | 6/1993 | |
| WO | WO 99/46539 | | 9/1999 | |

OTHER PUBLICATIONS www.polycity.com, "Child Resistant Lighters"; S9 Push--down Safety Lock; downloaded Oct. 7, 1999.

copy of lighter sample.

Digital Photos of AIM Lighter (4 sheets), purchased in Aug. of 1999.

U.S. application No. 08/583,214, filed Jan. 4, 1996 entitled "Safety Lighter with Smooth Striker Wheel Edges" to Sher.

U.S. application No. 08/640,195, filed Jan. 4, 1995 entitled "Childproof Piezoelectric Lighter with Sliding Mechanism" to Sher.

*Primary Examiner*—Sara Clarke
(74) *Attorney, Agent, or Firm*—Pennie & Edmonds LLP

(57) ABSTRACT

A child-resistant lighter is disclosed which includes an actuator and a latch member coupled thereto. The latch member includes a finger actuation portion and a body portion integrally formed therewith. The body portion has a free end. In accordance with one embodiment of the invention when in an inoperative position, the free end of the latch member is aligned with a blocking surface of the lighter body, thus, preventing inadvertent lighting of the lighter. When in an operative position, the free end of the latch member is pivoted out of alignment with the blocking surface so that the lighter can function. During pivoting, as the finger actuation portion moves in a first direction, the free end moves in an opposite, second direction. The first direction is substantially forward and the second direction is substantially rearward. In another embodiment, the latch member can be slidable coupled to the actuator. In another embodiment of the invention, the latch member includes the body portion and a cam member slidable coupled to the body portion. In yet another embodiment, a pulp portion of the user's finger is used to cause movement of the latch member from the locked position to the unlocked position and movement of the actuator from the first position to the actuation position.

37 Claims, 15 Drawing Sheets

U.S. PATENT DOCUMENTS 5,002,482 A 3/1991 Fairbanks et al.
5,035,608 A 7/1991 Parren
5,066,220 A 11/1991 Vick
5,074,781 A 12/1991 Fujita
5,090,893 A 2/1992 Floriot
5,125,829 A 6/1992 McDonough et al.
5,145,358 A * 9/1992 Shike et al. ..... 431/153
5,165,885 A 11/1992 Iwahori
5,165,886 A 11/1992 Frigiere
5,186,618 A 2/1993 Shike et al.
5,228,849 A * 7/1993 Frigiere ..... 431/255
5,240,408 A 8/1993 Kenjiro et al.
5,262,697 A 11/1993 Meury
5,288,226 A 2/1994 Khemarangsan
5,295,819 A 3/1994 Gómez López et al.
5,334,011 A 8/1994 Frigiére
5,348,467 A 9/1994 Piffath et al.
5,368,473 A 11/1994 Kenjiro et al.
5,409,372 A * 4/1995 Nobuo ..... 431/153
5,417,571 A 5/1995 Kvalseth
5,431,558 A 7/1995 McDonough et al.
5,435,719 A 7/1995 McDonough et al.
5,445,518 A 8/1995 McDonough et al.
5,456,598 A 10/1995 McDonough et al.
5,458,482 A 10/1995 Saito et al.
5,462,432 A * 10/1995 Kim ..... 431/153
5,468,144 A 11/1995 Iwahori
5,472,338 A 12/1995 Ansquer
5,487,657 A 1/1996 Fairbanks et al.
5,513,980 A 5/1996 Rasmussen et al.
5,531,591 A 7/1996 Yamazaki
5,538,417 A 7/1996 Chan
5,558,514 A 9/1996 Ansquer
5,584,682 A 12/1996 McDonough et al.
5,636,979 A 6/1997 McDonough et al.
5,642,993 A 7/1997 McDonough et al.
5,655,901 A 8/1997 Makoto
5,662,466 A 9/1997 Cheng
5,697,775 A 12/1997 Saito et al.
5,704,776 A 1/1998 Sher
5,735,294 A 4/1998 McDonough et al.
5,769,625 A 6/1998 Sher
5,788,474 A 8/1998 Chung et al.
5,788,476 A * 8/1998 Sher ..... 431/153
5,829,963 A 11/1998 Ichikawa
5,839,892 A 11/1998 Hwang
5,885,069 A 3/1999 Roglet
5,833,448 A 11/1999 Doucet et al.

* cited by examiner

CHILD RESISTANT LIGHTER

This application is a continuation-in-part of co-pending U.S. patent application No. 09/172,609, filed Oct. 15, 1998.

BACKGROUND OF THE INVENTION

1. Technical Field

The present invention relates to a lighter that employs an ignition system which presents increased difficulty of operation by unintended users.

2. Background Art

Disposable gas lighters are available in a variety of forms. One common element of disposable lighters is an actuator pad or lever used to initiate the flow of fuel. An actuator pad is operated in conjunction with a spark producing mechanism so that the flow of fuel is ignited soon after it commences. For example, lighters employing conventional spark wheels require a user to rotate a toothed spark wheel against a flint in order to generate a spark. The user then depresses the actuator pad, to release gas and produce a flame.

Another means of ignition for disposable lighters employs a piezoelectric mechanism. In this type of ignition mechanism, a piezoelectric element, such as a crystal, is struck by a plexor in order to produce an electric spark. The spark is conducted to a location near the opening of the valve to ignite the gaseous fuel. The actuator pad, upon forced depression by a user, commences both the flow of the fuel and the ignition process. An example of such a piezoelectric ignition mechanism is disclosed in U.S. Pat. No. 5,262,697, entitled "Piezoelectric Mechanism For Gas Lighters."

As with spark wheel ignition mechanisms, measures have been introduced to increase the difficulty of activation to inhibit unintended activation of piezoelectric mechanisms or activation by unintended users (e.g., children younger than five years of age). One typical method is to incorporate a separate latch member disposed under the actuator pad, which inhibits depression of the actuator pad. Examples of such mechanisms are shown in U.S. Pat. Nos. 5,435,719, 5,584,682, and 5,636,979.

There remains, however, a need in the art for other mechanisms, which increase the difficulty of unintentional operation or operation by unintended users, and at the same time are user-friendly for intentional operation by intended users.

SUMMARY OF THE INVENTION

According to the present invention a lighter resistant to use by unintended users is disclosed. The lighter comprises a housing with a fuel supply and a blocking surface, a valve for controlling the release of fuel from the fuel supply, an actuator, an ignition mechanism, and a latch member. The actuator is mounted for movement with respect to the housing from a first position to an actuation position. The ignition mechanism is coupled to the actuator, and the actuator is movable from the first position to the actuation position along a longitudinal, actuation axis. This movement of the actuator allows the ignition mechanism to ignite the fuel. The latch member is pivotally or slidably coupled to the actuator. The latch member includes a finger actuation portion and a body portion with a blocking or free end.

When the latch member is in the first position, the blocking end of the body portion of the latch member is aligned with the blocking surface of the housing to prevent actuation of the lighter by limiting the movement of the actuator along the actuation axis. When the latch member is pivotally coupled to the actuator, moving the finger actuation portion of the latch member in a first direction causes the blocking end of the body portion to move in a second direction substantially opposite the first direction. This also causes the blocking end of the latch member to become unaligned with the blocking surface of the housing. This unalignment is the intermediate or unlocked position. This permits movement of the actuator from the first position to the actuation position to actuate the lighter. In one embodiment, during the movement of the latch toward the intermediate position, the finger actuation portion moves in the first direction, which is substantially forward, and the blocking end moves in the second direction which is substantially rearward. When the latch member is slidably coupled to the actuator, during the movement of the latch toward the intermediate position, the finger actuation portion and the blocking end move in substantially the same direction.

In yet another embodiment, the lighter further includes a biasing element for biasing the latch member into the first position.

In accordance with one aspect of the invention, movement of the latch member toward the intermediate position is caused by a portion of the pulp of a user's finger that contacts the finger actuation portion.

In accordance with another embodiment, the latch member further includes a body portion with an upper cam surface and a separate cam member. The cam member has the finger actuation portion on the upper surface and a lower cam surface. The cam member is slidably coupled to the body portion such that the lower cam surface contacts the upper cam surface during actuation of the latch member. In accordance with one aspect of this embodiment, in the first position the finger actuation portion is positioned above the outer surface of the actuator and in the intermediate position the finger actuation portion is disposed below the outer surface of the actuator. In accordance with another aspect of this embodiment, the finger actuation portion is below the outer surface of the actuator in the first and intermediate positions.

In yet another embodiment, a lighter comprises a housing, a valve, an actuator and a biased latch member coupled to the actuator. In the first position, the latch member prevents movement of the actuator from the first position to the actuation position. In the intermediate position, the latch member permits movement of the actuator from the first position to the actuation position to ignite the fuel. A user contacts the latch member with a pulp portion of the user's finger to cause movement of the latch member from the first position to the intermediate position and movement of the actuator from the first position to the actuation position. Upon the user releasing the latch member, the latch member is biased into the first position. The latch member is slidably coupled to the actuator. In another embodiment, the latch member is pivotally coupled to the actuator. In yet another embodiment, the latch member can be slidably or pivotally coupled to a side wall of the actuator.

BRIEF DESCRIPTION OF THE DRAWINGS

To facilitate the understanding of the characteristics of the invention, the following drawings have been provided wherein.

DESCRIPTION OF THE PREFERRED EMBODIMENTS

Figure 1:
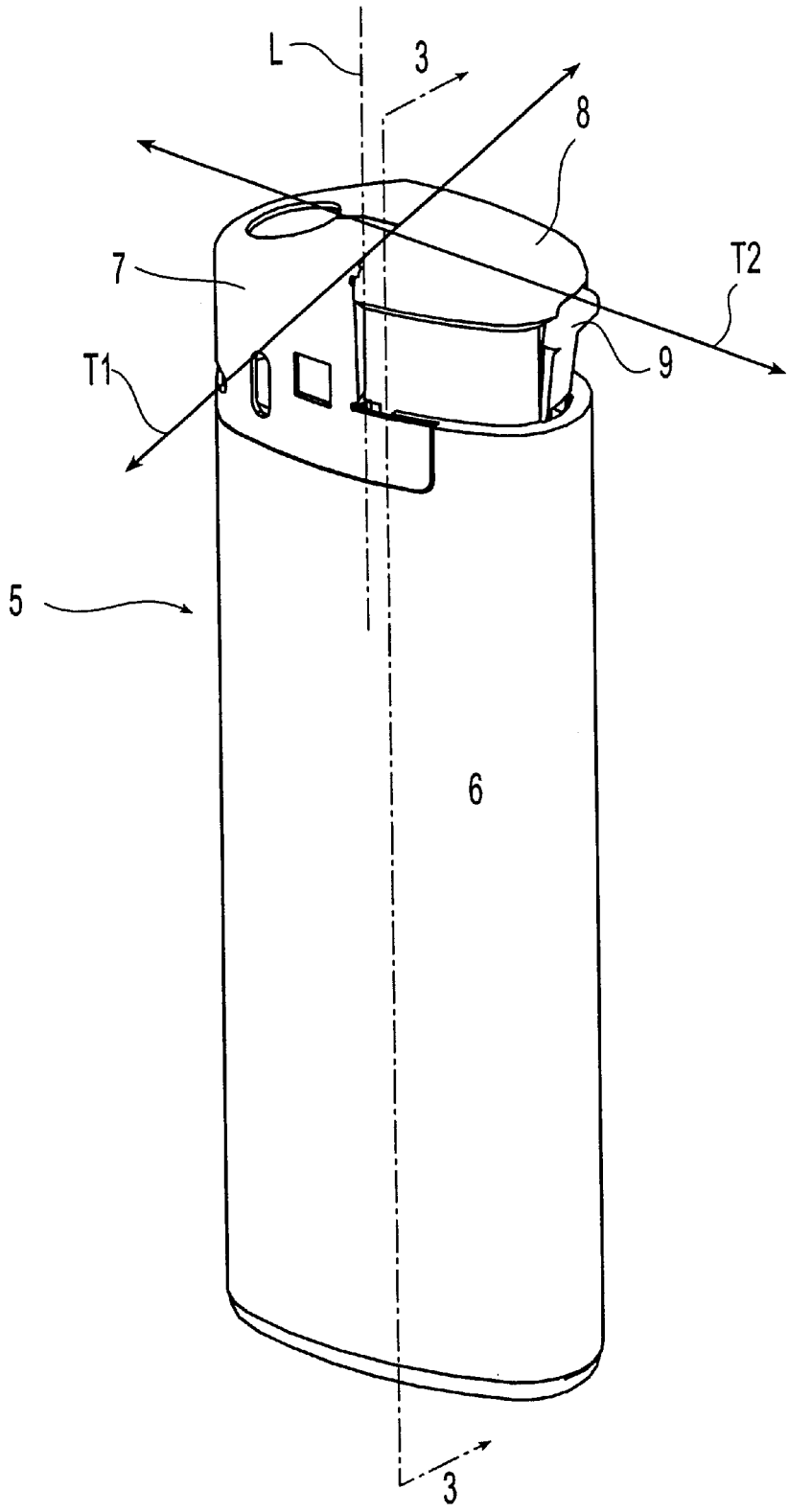
FIG. 1 is a rear, perspective view of a lighter having an actuator and a latch member formed in accordance with the present invention.

Referring to the drawings, wherein like reference numbers are used to designate like parts, and as shown in FIG. 1, a lighter 5 having an actuation inhibiting mechanism formed in accordance with the principles of the present invention is shown. For reference, the lighter 5 has a longitudinal or actuation axis L, a first transverse axis T1 perpendicular to axis L, a second transverse axis T2 that is perpendicular to both the longitudinal and first transverse axis. The lighter 5 further includes a housing or body portion 6, a wind shield 7, a depressible actuator 8, and a latch member 9.

Figure 2:
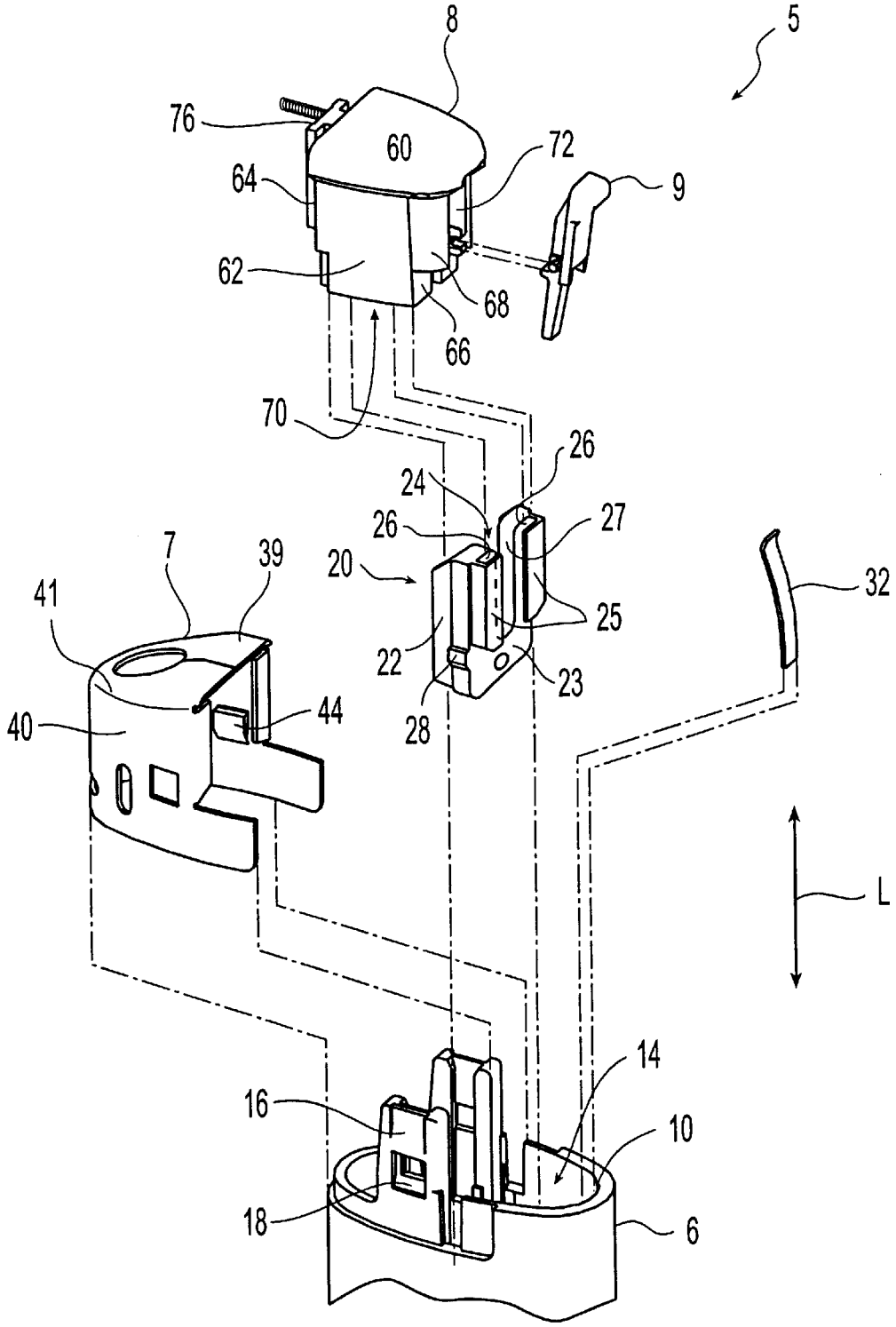
FIG. 2 is an exploded, rear, perspective view of the lighter of FIG. 1 showing a portion of a housing, a wind shield, a guide, an actuator, a latch member, and a biasing element.
Figure 3:
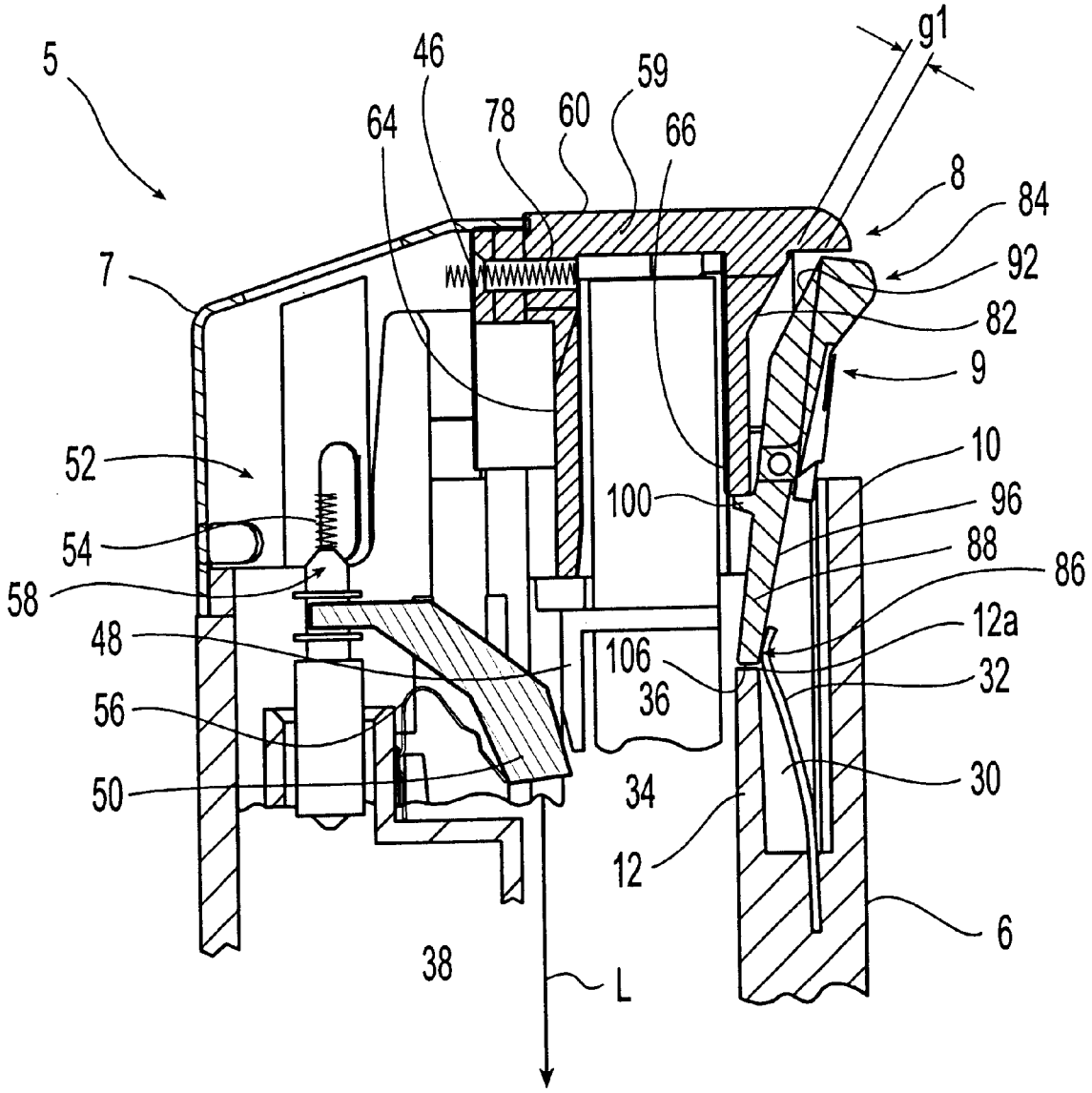
FIG. 3 is a partial, enlarged, front longitudinal view, in partial cross-section, along line 3—3, of the lighter of FIG. 1 showing the actuator and latch member in an inoperative position.

Referring to FIGS. 2 and 3, the housing 6 further includes an outer wall 10, a plurality of inner walls, such as inner wall 12, for defining an opening 14 at the top of the housing, a plurality of support members 16, and a plurality of chambers discussed below. The upper surface 12*a* of the inner wall 12 acts as a blocking surface.

The opening 14 receives the actuator 8 and latch member 9. The actuator 8 and housing 6 are configured so that the actuator 8 slides along the longitudinal axis L with respect to the housing 6. The support members 16 extend upwardly from the outer wall 10, and are spaced apart. Each support member 16 defines an opening 18 there through adapted to receive a guide 20. The guide 20 includes two spaced, parallel side walls 22 that are joined together by a central wall 23. A space 24 is defined between the front ends of the side walls 22. The rear ends of each of the side walls 22 include a transversely extending wall portion 25 that defines a longitudinally extending slot 26. The central wall 23 of the guide defines a slot 27. The outer surface of each of the side walls 22 includes an outwardly extending projection 28. The projections 28 are sized to fit within the openings 18 on support members 16. The housing, actuator, guide, and latch member may be made with plastic material. However, the latch member can also be metal. It is recommended that the latch is formed of die-cast zinc or aluminum. However, the present invention is not limited to these types of metals.

When the lighter is assembled, the guide 20 is disposed between the support members 16, and the support members 16 flex outward to accommodate the guide 20. Once the projections 28 are aligned with the openings 18, the support members 16 return to their vertical, initial position. The interaction between the projections 28 and the openings 18 allow the guide 20 to be retained within the housing 6.

The first chamber 30 receives a biasing element 32. In this embodiment, the biasing element 32 is a metal leaf spring with one end coupled, e.g., embedded, to the housing 6 and a movable opposite end. The second chamber 34 (partially shown) receives a piezoelectric ignition mechanism 36. The third chamber 38 (partially shown) contains a fuel supply (not shown).

The wind shield 7 includes a top wall 39 and U-shaped side wall 40 extends downwardly from the top wall. The side wall 40 includes two inwardly extending tabs 44. The tabs 44 are spaced apart on opposite sides of the wind shield. When the wind shield 7 is connected to the housing 12, the tabs 44 are disposed in the openings 18. The tabs 44 secure the wind shield 7 to the housing 6.

Referring to FIG. 3, the ignition system of lighter 5 includes piezoelectric ignition mechanism 36 which is represented schematically. The present invention is not limited to a particular type of ignition mechanism and various types of piezoelectric mechanisms and nonpiezoelectric mechanisms can be used. One suitable piezoelectric ignition mechanism 36 for lighter 5 is disclosed in U.S. Pat. No. 5,262,697, entitled "Piezoelectric Mechanism For Gas Lighters" which is expressly incorporated by reference herein in its entirety. Another suitable type of ignition mechanism includes a spark-wheel and flint. An example of a spark-wheel and flint ignition mechanism that can be used with the present invention is disclosed in U.S. Pat. No. 5,468,144 issued to Iwahori.

Piezoelectric mechanism 36 is one element in an electrical circuit including, among other components, first electrode 46, cam member 48, valve actuator 50, valve system 52 and second electrode 54. After the piezoelectric mechanism is compressed, as known by those of ordinary skill in the art, an electrical potential difference is created that is conducted through this circuit, and creates substantially the same potential difference between first electrode 46 and second electrode 54. This potential difference is sufficient to discharge a spark across the air gap between the two electrodes. In other words, the two electrodes act similar to a capacitor with an air dielectric disposed there between. Any electrically conductive material may be utilized to make the components of this circuit. A person of ordinary skill in the art may select suitable materials for the various components in this circuit.

When the actuator 8 is depressed to create the spark, cam member 48 is also depressed, and acts on valve actuator 50. Valve actuator 50 is pivoted such that when cam member 48 pushes one end of valve actuator 50 downward, the other end is moved upward thereby lifting valve system 52 to release fuel gas. The released gas is then ignited by the spark discharged between electrodes 46 and 54.

Valve system 52 controls the release of fuel from the fuel supply. In a preferred embodiment, the fuel supply is compressed hydrocarbon gas and valve system 52 normally has an open valve that is forced closed by the pressure of a spring member 56. In this embodiment, valve actuator 50 acts on valve system 52 to lift valve stem 58 upward to release the compressed hydrocarbon gas.

Figure 4:
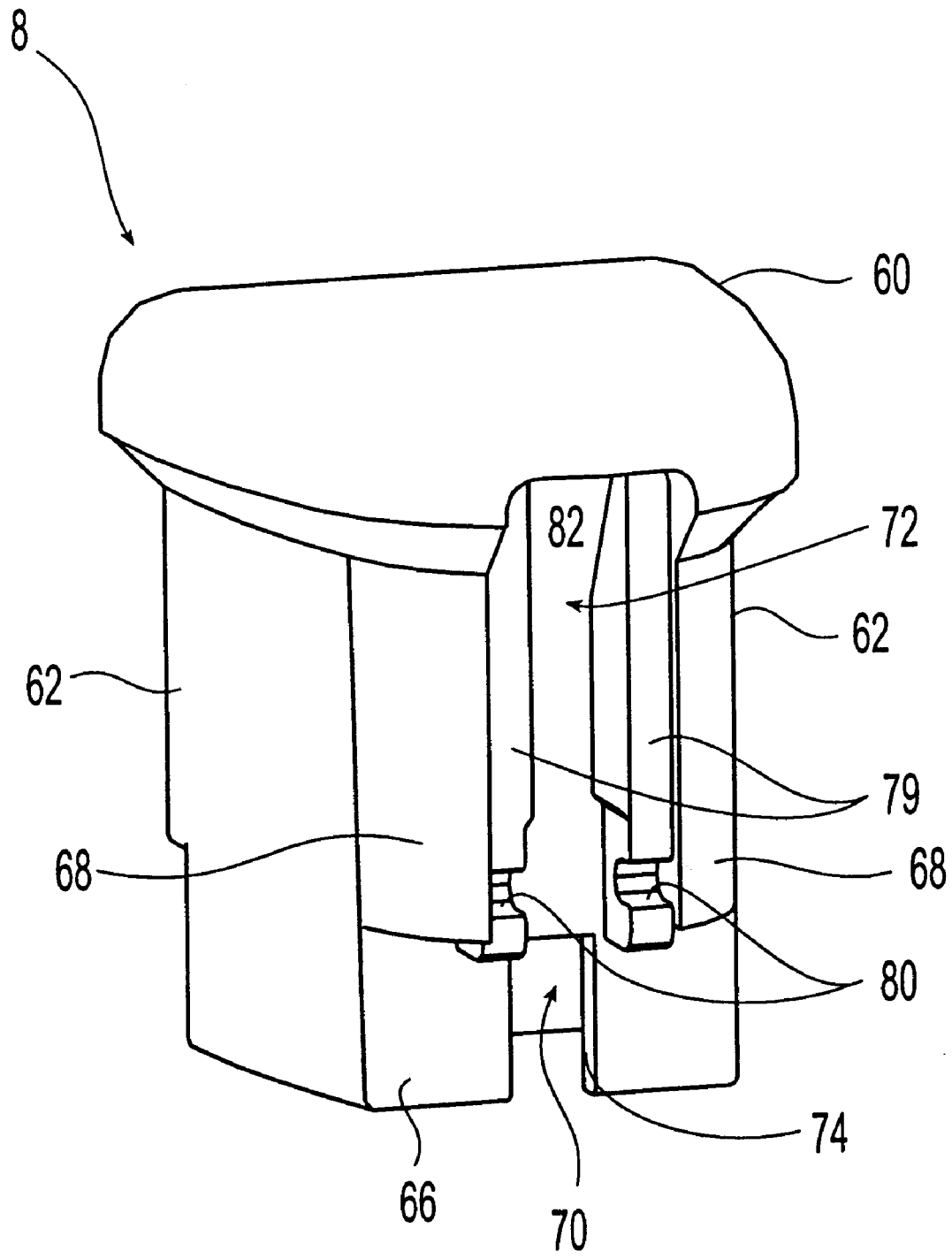
FIG. 4 is an enlarged, rear, perspective view of the actuator of FIG. 2.

Referring to FIGS. 2–4, the actuator 8 comprises a top wall 59 having a top surface 60, spaced parallel side walls 62, front wall 64, intermediate wall 66, and rear walls 68. The walls 62, 64, 66, and 68 are joined to the top wall 59. Walls 62, 64, 66 and top wall 59 define a chamber 70 for receiving the piezoelectric mechanism 36. The intermediate wall 66, rear walls 68 and top wall 59 define a cutout 72 for receiving the latch member 9. Inner wall 66 also defines a cutout 74. The actuator front wall 64 includes a projection 76 with a T-shaped cross-sectional shape and the front wall defines a bore 78 for receiving the first electrode 46. The electrode 46 extends through the bore 78 and contacts the piezoelectric mechanism 36.

The actuator 8 further includes transversely spaced, longitudinally extending ribs 79. Each rib 79 is disposed within the cutout 72, and each rib 79 is adjacent to an associated rear wall 68. Each rib 79 at the lower end defines a pin receiving cutout 80. The pin receiving cutout 80 opens rearwardly. The actuator 8 further includes a longitudinally extending contoured surface 82 between ribs 79.

When the actuator 8 is assembled to the housing 6 and guide 20, the projection 76 is disposed within the guide slot 26 so that the actuator can slide along longitudinal axis L with respect to the guide. When the actuator 8 is slidably connected to the guide 20, the electrode 46 (shown in FIG. 3) is disposed within slot 27. The top wall 39 of the wind shield 7 retains the actuator within the lighter.

Figure 5:
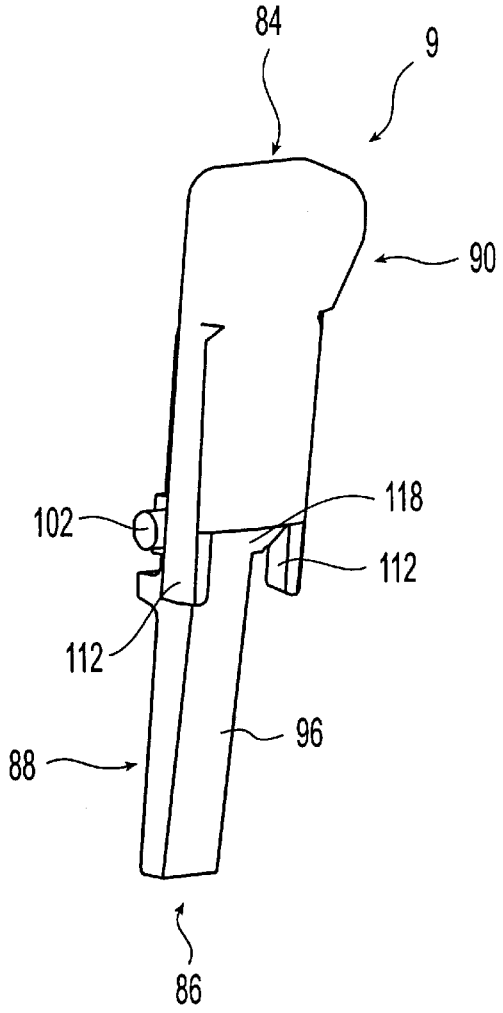
FIG. 5 is an enlarged, rear, perspective view of the latch member shown in FIG. 9.
Figure 6:
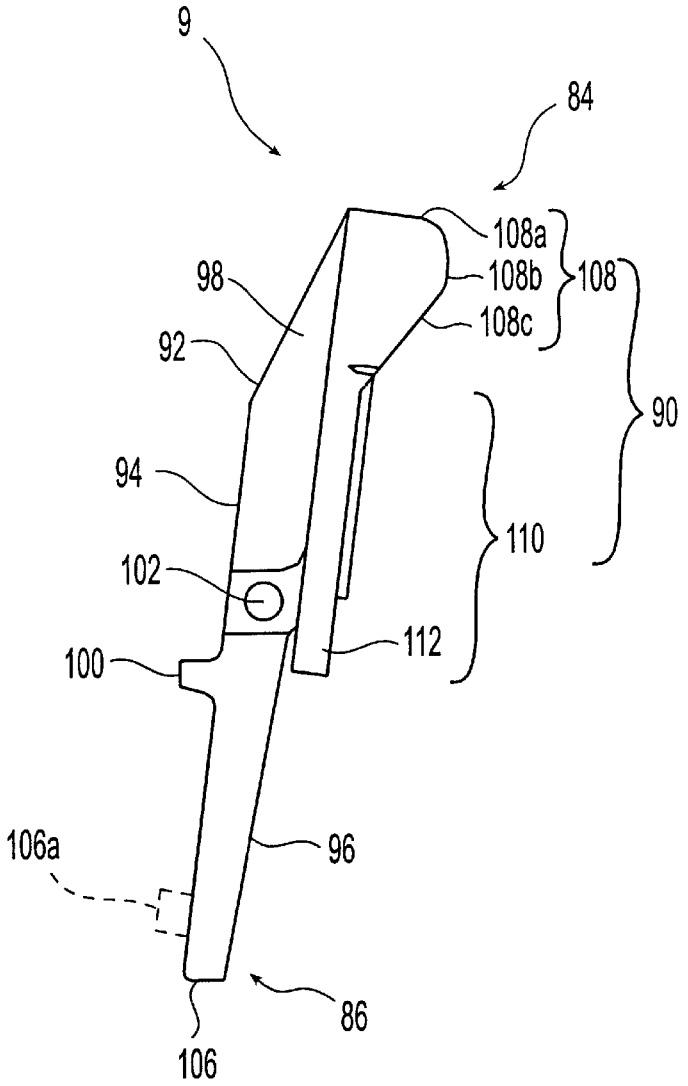
FIG. 6 is an enlarged, side view of the latch member shown in FIG. 5.

Referring to FIGS. 5 and 6, the latch member 9 comprises a first end 84, a spaced second end 86, a first or body portion 88, and a second portion 90. If the latch member is plastic, the portion 90 is integrally molded with the portion 88. The portion 88 extends longitudinally from the first end 84 to the second end 86. The portion 88 includes inner surfaces 92 and 94, a spaced outer surface 96, and two side surfaces 98. The inner surface 92 is slanted and extends downwardly from the first end 84. The inner surface 94 is angularly offset from the inner surface 92. The inner surface 94 extends from surface 92 to the second end 86. The inner surface 94 includes an outwardly extending ledge 100. Each side surface 98 includes a transversely extending pin 102. The portion 88 further includes a lower surface or blocking end or free end 106 at the second end 86 of the latch member. The tern "free end" means a surface of the latch member that contacts the blocking surface 12*a* (as shown in FIG. 3) in the first position to prevent actuation. In another embodiment, the latch member can include a projection with a free end 106a (shown in phantom in FIG. 6) that extends from the inner surface 94 of the latch member. In the first position, the free end 106*a* contacts the blocking surface 12*a* (as shown in FIG. 3) to prevent actuation.

The second portion 90 extends from the first end 84 of the latch member 9 to about the ledge 100. The portion 90 includes a first section or finger actuation portion 108 that extends from the first end 84. The finger actuation portion 108 includes a top surface 108*a*, a curved surface 108*a*, and a slanted surface 108*c*. The second section or medial portion 110 extends from the slanted surface 108*c* and is substantially parallel to the inner surface 94 of the body portion. The second section 110 ends in two transversely spaced projections 112 that extend on either side of the body portion 88. The medial portion 110 further includes an angled surface 118 that is disposed between the projections 112. The latch member 9 is shaped to complement the cutout 72 (as best shown in FIG. 4) and contoured surface 82 of the actuator.

Referring to FIGS. 2, 4 and 6, when the latch 9 is assembled within the lighter, the latch 9 is disposed within the cutout 72 and the pins 102 are received within the cutouts 80 of the actuator. The latch member 9 can pivot with respect to the housing 6 and actuator 8. The angled surface 118 and the cutout 74 allow clearance for spring 32 when the actuator is depressed.

As shown in FIG. 3, when the latch member 9 is in a first position, which is a locked or inoperative position, the biasing element 32 acts on the outer surface 96 of the body portion 88. The biasing element 32 forces the lower end 86 of the body portion forward so that the blocking or free end 106 of the body portion is aligned with the blocking surface 12*a* of the housing inner wall 12. Thus, depression of the actuator 8 along the actuation axis L is arrested, and inadvertent actuation of the lighter is prevented. The ledge 100 cooperates with the intermediate wall 66 of the actuator 8 to help prevent over rotation of the latch member 9 by the biasing element 32. The latch 9 and actuator 8 are configured so that the latch surface 92 is spaced from the actuator surface 82 at the first end 84 in the first or locked position. Thus, the surfaces 82 and 92 define a gap g1 between the latch and actuator at the end 84 in the first or locked position.

Figure 7:
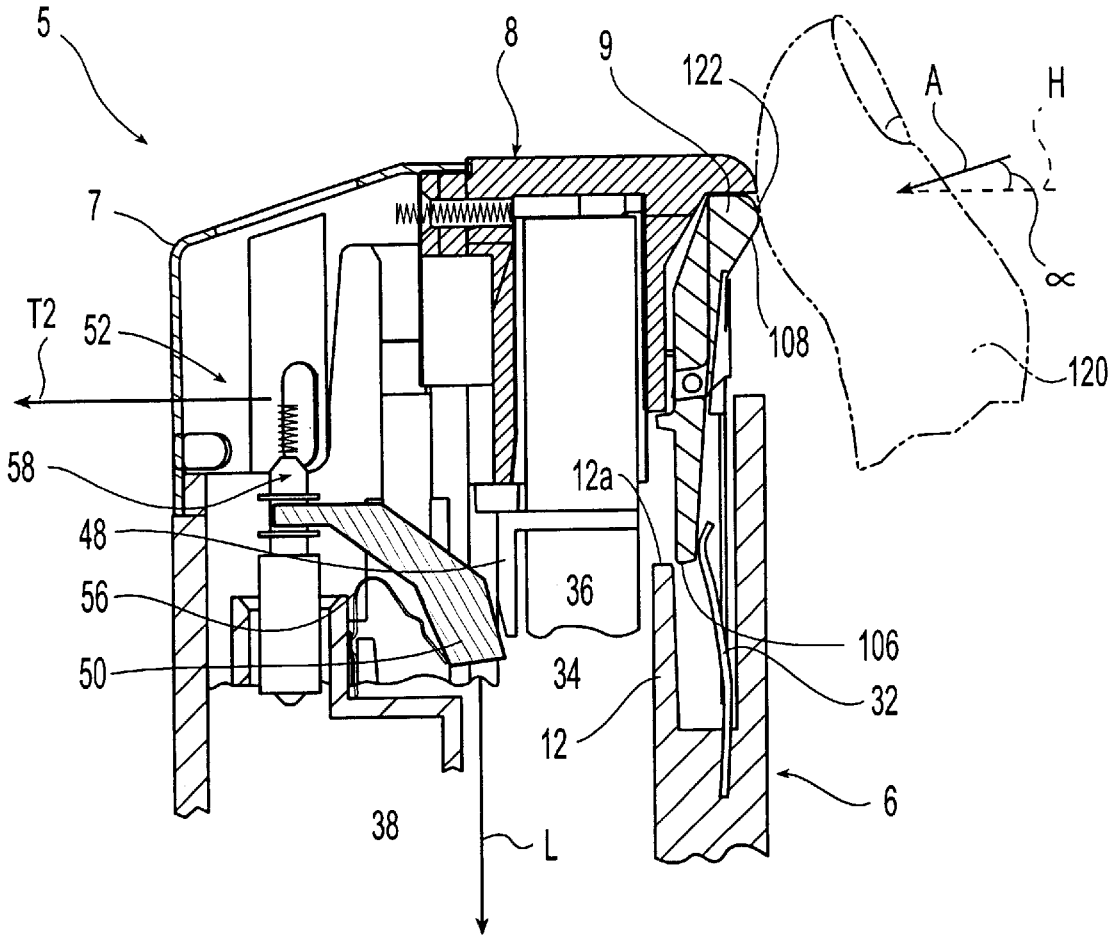
FIG. 7 is a partial, enlarged, front longitudinal view, in partial cross-section of the lighter of FIG. 3 showing the actuator and latch member in an intermediate position due to a user's finger movement.
Figure 8:
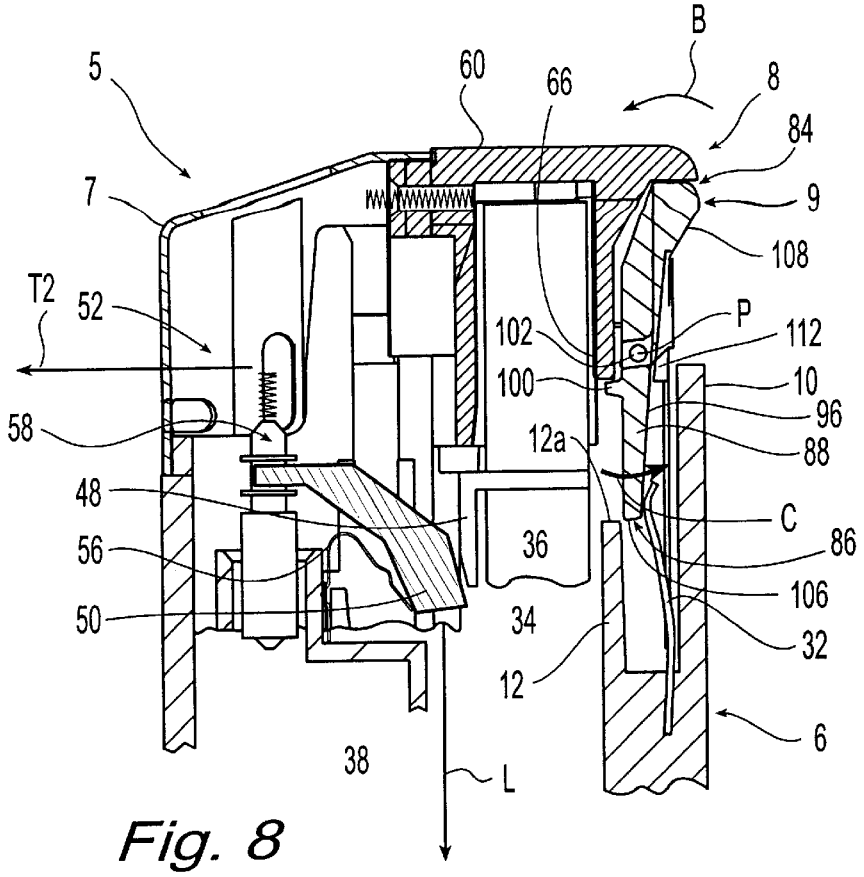
FIG. 8 is a partial, enlarged, front longitudinal view, in partial cross-section of the lighter of FIG. 7 showing the actuator and latch member in the intermediate position, wherein the finger has been removed for clarity.

Referring to FIG. 7, in order to release gas and generate a spark, the latch member 9 is moved to an intermediate position, which is an unlocked or operative position, as shown. A user contacts the finger actuation portion 108 of the latch member 9 moving in a direction illustrated by the arrow A. It is preferred that the finger 120 of the user contacts the finger actuation portion 108. A portion 122 of the pulp of the finger 120 comes in contact with the finger actuation portion 108. This permits the unlocking of latch 9. The direction of the user's finger movement forms an angle $\alpha$ with a horizontal plane H. Angle $\alpha$ is between 0° and less than about 90° from the horizontal plane H. More preferably, $\alpha$ is between about 20° to about 40° from the horizontal plane H. Most preferably, $\alpha$ is about 30° from horizontal. Referring to FIG. 8, the user's finger moves the first end 84 of the latch member 9 in a first direction, as indicated by the arrow B. The first direction is substantially forward, which is toward the valve system 52. This direction is also generally along the direction T2. This causes the latch member 9 to pivot about the axis P via the pins 102 and moves latch member 9 closing gap g1 (as shown in FIG. 3). As the latch member 9 pivots, the second end 86 of the latch member 9 moves in a second direction, as indicated by arrow C, that is opposite the first direction of arrow B. The second direction is substantially rearward, which is away from the valve system 52. The second direction is also generally along the direction T2. Also, the outer surface 96 of the body portion 88 compresses the biasing clement 32.

With the lighter in the intermediate position (as shown in FIGS. 7 and 8), a user may depress the actuator 8 with their finger 120 (as shown in FIG. 7) along the longitudinal axis causing the latch member 9 and actuator 8 to move downwardly along the actuation axis L toward the actuation position. This movement releases fuel gas and compresses the piezoelectric mechanism 36, thereby actuating the lighter.

After ignition, the user simply releases the actuator 8, thereby allowing a spring (not shown) within the piezoelectric to raise the actuator. Once the latch member 9 is released, the biasing element 32 biases the second end 86 of the latch member 9 forward until the blocking or free end 106 is again aligned with the blocking surface 12*a* , so that the lighter is again in the inoperative position.

Figure 9:
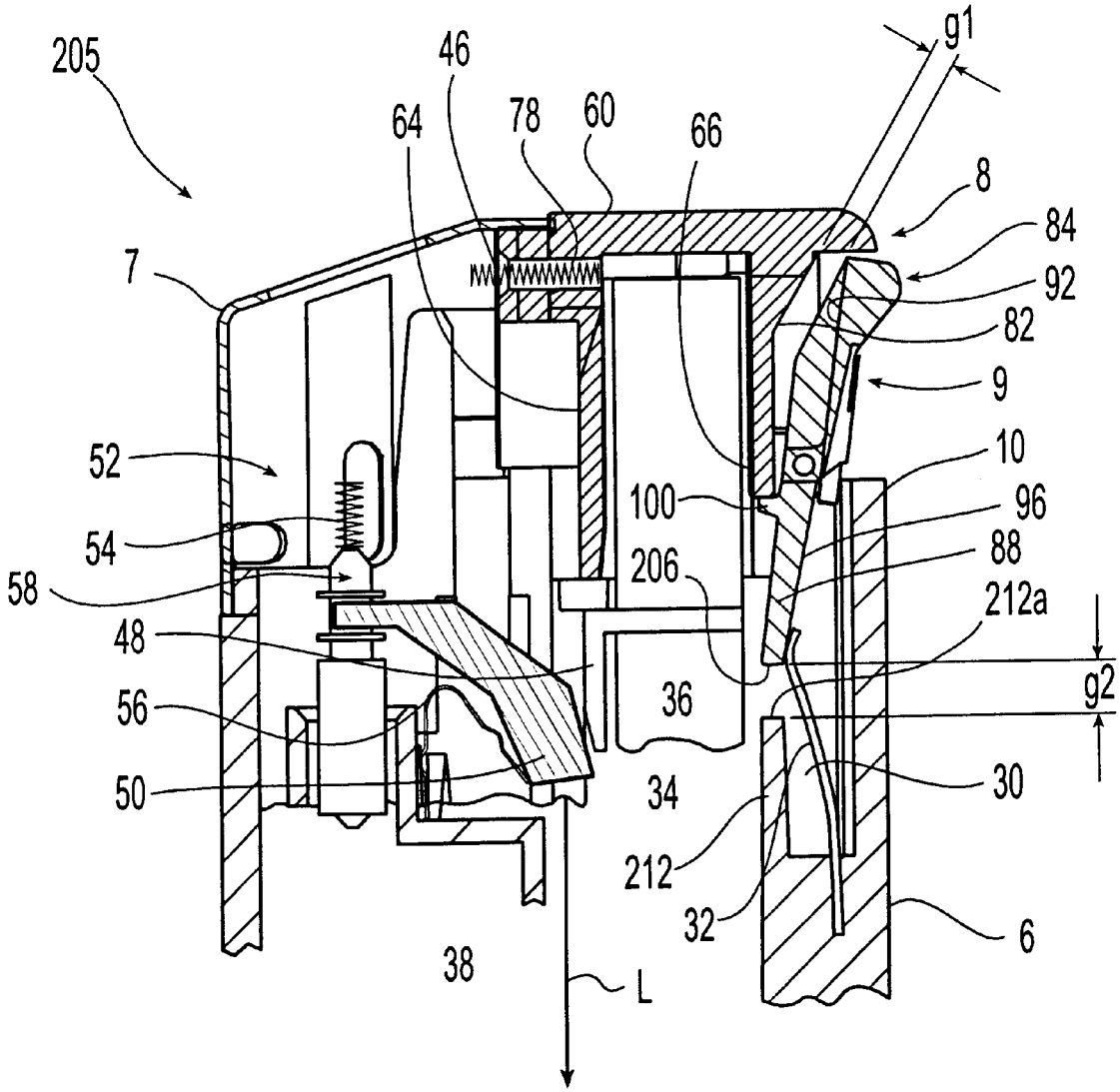
FIG. 9 is a partial, enlarged, front longitudinal view, in partial cross-section of an alternative embodiment of a lighter formed in accordance with the present invention showing the actuator and latch member in a first or inoperative position.

Referring to FIG. 9, a lighter 205 in accordance to another embodiment is shown. The housing 6 of the lighter has been modified so that in the inoperative position there is a second gap g2 defined between the latch member 9 and the blocking surface 212*a* of the housing inner wall 212. The second gap g2 is dimensioned so that with the latch member 9 in the first position the user can partially move or depress the actuator 8 along the longitudinal axis L. The blocking end 206 of the latch member 9 comes into contact with the blocking surface 212*a* before the piezoelectric element 36 is compressed sufficiently to create a spark. In this way, actuation of the lighter may be prevented by preventing spark generation. In another embodiment, this type of prevention can be achieved by changing the dimensions of the latch member instead of the housing inner wall.

Figure 10:
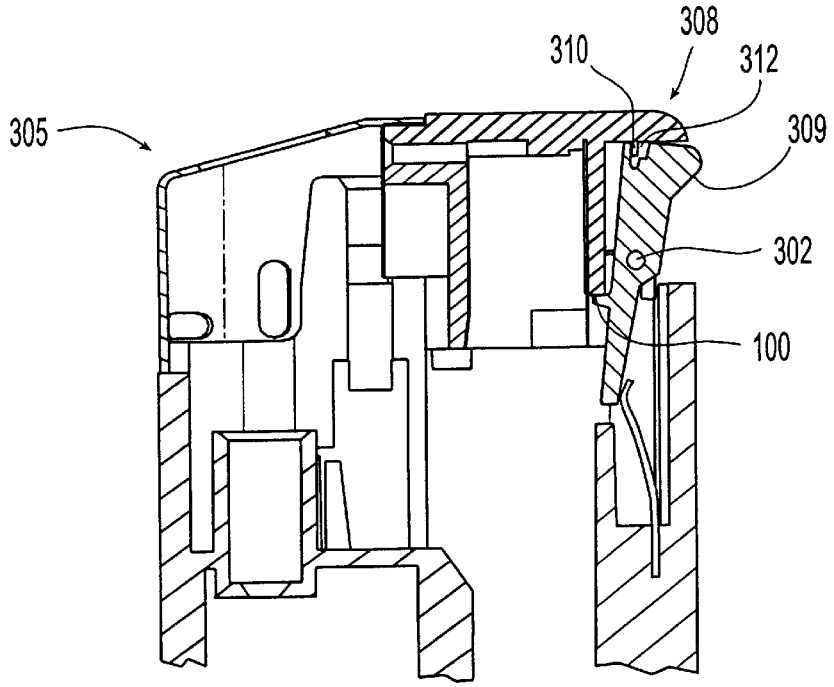
FIG. 10 is an enlarged, cross-sectional view of an alternative embodiment of the actuator and latch member.

Referring to FIG. 10, a lighter 305 of another embodiment is illustrated. The lighter 305 is substantially similar to the lighter 205 shown in FIG. 9, except that it has an additional rotation limiting mechanism to prevent the over-rotation of the latch 309, in addition to the ledge 100. The rotation limiting mechanism includes a ledge 310 dependent from the actuator 308, which is sized and dimensioned to be received in cavity 312 defined on the top portion of latch 309. Cavity 312 is sized so that ledge 310 may freely move there within when latch 309 is moved to the intermediate position. Alternatively, latch 309 may pivot relative to actuator 308 without transversely extending pins 302 being rotatably received in the pin receiving cutouts, such as members 80 illustrated in FIG. 4. Actuator 308 and latch 309 may have corresponding contacting cam surfaces that roll relative to each other to produce pivotal movement by the latch. Such contacting cam surfaces are fully described and illustrated in co-pending parent application Ser. No. 09/172,609, which is expressly incorporated herein by reference in its entirety.

Figure 11:
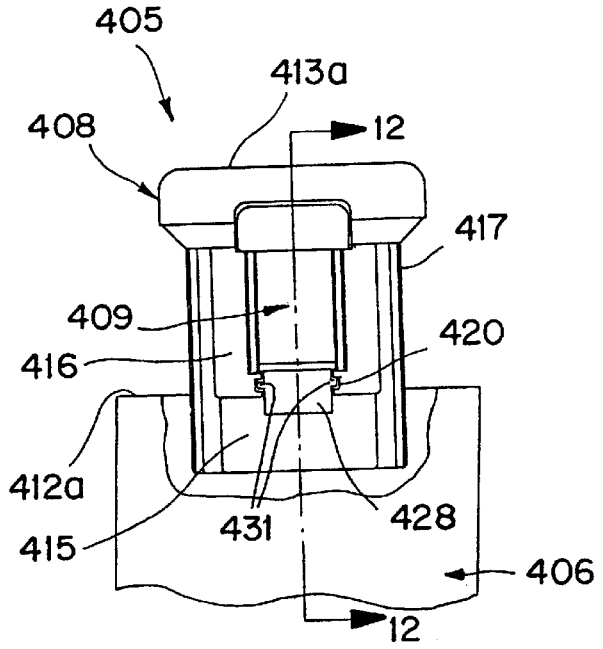
FIG. 11 is a rear view of another embodiment of a lighter having an actuator and a latch member formed in accordance with the present invention.
Figure 12:
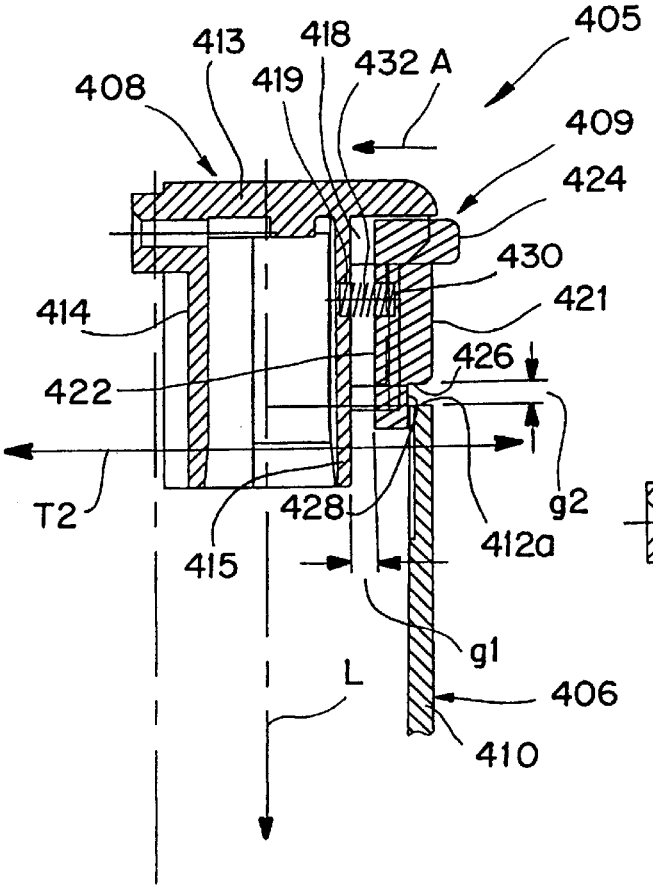
FIG. 12 is a partial, front longitudinal view, in partial cross-section of the lighter of FIG. 11 taken along the line 12—12 with the actuator and latch member in the first or inoperative position.
Figure 13:
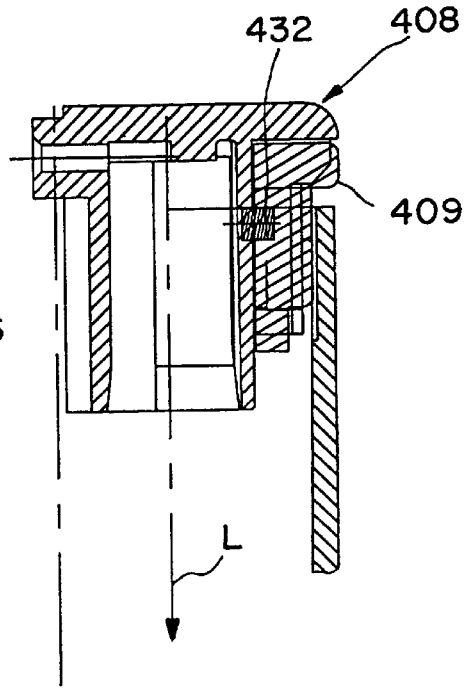
FIG. 13 is a partial, front longitudinal view, in partial cross-section of the lighter of FIG. 12 showing the actuator and latch member in an actuation position.

Turning to FIGS. 11–13, a lighter 405 in accordance to another embodiment is shown. The lighter 405 includes a housing 406, an actuator 408 and a latch member 409. The housing 406 has an outer wall 410 with an upper or blocking surface 412*a* . The actuator 408 includes a top wall 413 with a top surface 413*a*, a front wall 414, an intermediate wall 415, two rear walls 416 and two side walls 417. Walls 413, 414, 415, and 417 define a chamber for receiving a piezoelectric unit, as discussed above. Walls 413, 415 and 416 define a cavity 418. The cavity 418 receives the latch member 409. The intermediate wall 415 defines a bore 419. Rear walls 416 further define slots 420 extending along the second transverse axis T2.

The latch member 409 includes an outer surface 421, an opposed inner surface 422, a finger actuation portion 424, a shoulder 426, and an extension 428. The inner surface 422 of the latch member 409 defines a bore 430. As best seen in FIG. 11, the latch member 409 further includes projections 431 that are slidably received in the slots 420 of the actuator 408 so that the latch member may slide relative to the actuator.

The lighter 405 further includes a biasing element 432, which in this embodiment is a coil spring. Referring to FIG. 12, which illustrates the lighter in the first position, the biasing clement 432 is disposed between the actuator 408 and the latch member 409 in the bores 419 and 430, respectively. The biasing element 432 forces the latch member 409 rearward so that the latch member is biased into the first or inoperative position. In this first position, a first gap g1 is defined between the actuator and the latch member and a second gap g2 is defined between the latch member shoulder 426 and the blocking surface 412*a*. In the first position, the shoulder 426 of the latch member is aligned with the blocking surface 412*a*.

The second gap g2 is dimensioned so that when the latch member 409 is in the inoperative position the user may partially move or depress the actuator 408 along the longitudinal axis. The shoulder 426 or blocking end of the latch member 409 comes into contact with the blocking surface 412*a* before the piezoelectric (not shown) is compressed sufficiently to create a spark. In this way, actuation is prevented by preventing spark creation. Alternatively, gap g2 may be reduced such that basically no movement of the actuator is allowed in the inoperative position.

Referring to FIG. 12, a portion of the pulp of user's finger (not shown) contacts the finger actuation portion 424 of the latch member 409, and moves the latch member in a first direction A along the axis T2. As the latch member slides relative to the actuator the first gap g1 decreases. Consequently, the shoulder 426 of the latch member moves out of alignment with the blocking surface 412*a* so that the lighter is in the intermediate, unlocked or operative position, and compresses the biasing element 432. Referring to FIG. 13, with the latch member in the intermediate position, a user may depress the actuator 408 with his or her finger along the longitudinal axis L causing the latch member 409 and actuator 408 to move downwardly along the axis L to the actuated position. This movement releases gas and compresses the piezoelectric mechanism to create a spark to cause actuation of the lighter.

Figure 14:
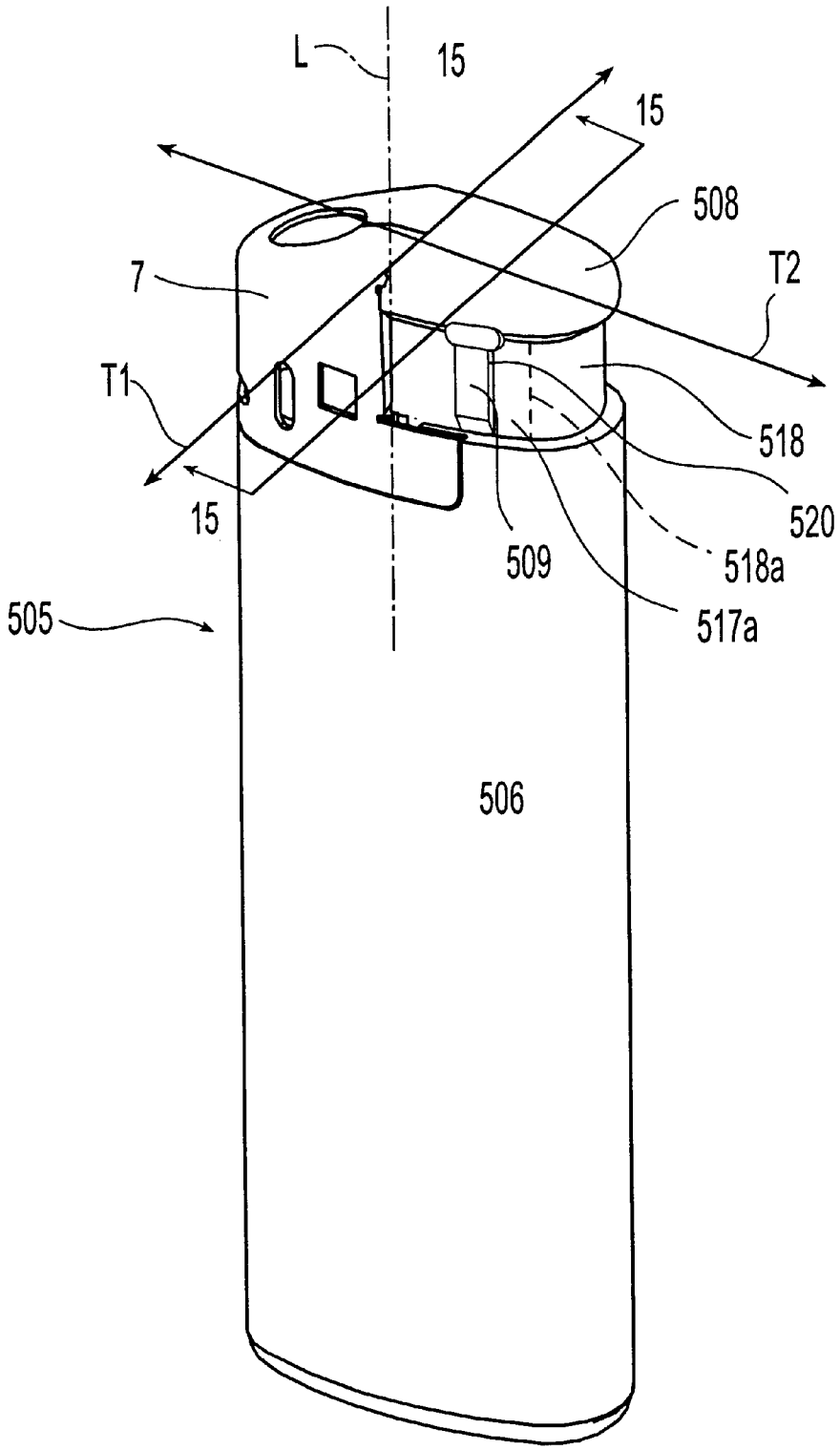
FIG. 14 is a rear, perspective view of another embodiment of a lighter having an actuator and a latch member formed in accordance with the present invention.
Figure 16:
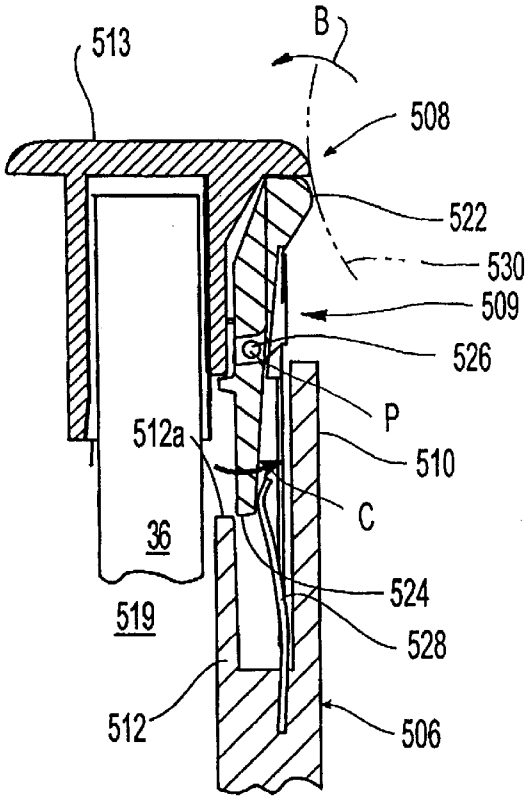
FIG. 16 is a partial, longitudinal view, in partial cross-section of the lighter similar to FIG. 15 showing the actuator and latch member in the intermediate position.
Figure 15:
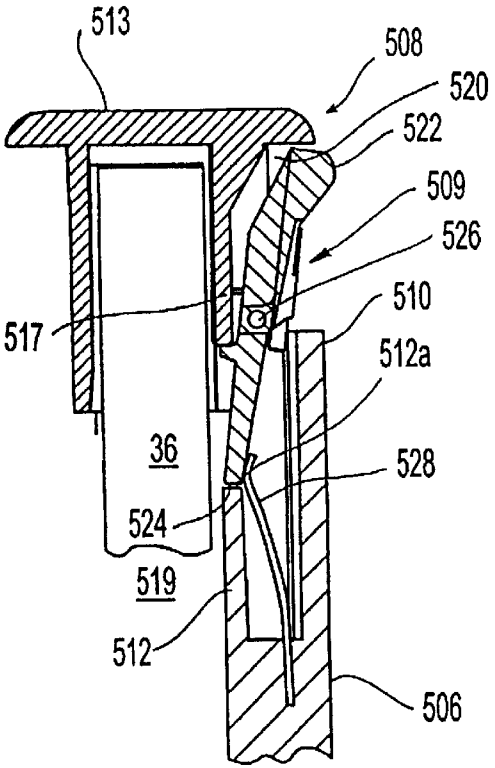
FIG. 15 is a partial, side longitudinal view, in partial cross-section of the lighter taken along line 15—15 of FIG. 14 showing the actuator and latch member in the first or inoperative position.

Referring to FIGS. 14–16, a lighter 505 in accordance to another embodiment is shown. The lighter 505 includes a housing 506, an actuator 508 and a latch member 509. The housing 506 includes an outer wall 510 with a spaced inner wall 512. The inner wall 512 has an upper or blocking surface 512*a*.

The actuator 508 includes a top wall 513 with a top surface 513*a*, front and intermediate walls (not shown), two side walls 517*a* and 517*b* joined by a curved rear wall section 518 (set apart by the phantom line 518*a*). The top wall, intermediate wall, rear wall and the side walls define a chamber 519 for receiving a piezoelectric unit 36, as discussed above. The side wall 517*a* defines a cutout 520. The cutout 520 includes ribs with pin cutouts, as shown in the actuator embodiment illustrated in FIG. 4. The cutout 520 receives the latch member 509. The latch member 509 includes a finger actuation portion 522, a free end or blocking end 524, and pins 526 extending substantially parallel the axis T2 (as shown in FIG. 14). The pins 526 are received in the pin cutouts (not shown) in the actuator so that the latch member is pivotally coupled to the actuator. In another embodiment, the latch member 509 can be located at another position on the side walls of the actuator 508.

The lighter 505 further includes a biasing element 528 which in this embodiment is a leaf spring. Referring to FIG. 15, the biasing element 528 is disposed between the housing outer wall 510 and the latch member 509. The biasing clement 528 forces the latch member 509 into the first or inoperative position. In the first position, the blocking end 524 of the latch member is aligned with the blocking surface 512*a*. If the actuator is depressed, the blocking end 524 contacts the blocking surface 512*a*, before the piezoelectric 36 is compressed sufficiently to create a spark.

Referring to FIG. 16, a portion of the pulp of user's finger 530 (shown in phantom) contacts the finger actuation portion 522 of the latch member 509, and moves the finger actuation portion 522 of the latch member 509 in a first direction, as indicated by the arrow B. The first direction is substantially inward. This direction is also generally along the direction of T1 (as shown in FIG. 14). This causes the latch member 509 to pivot about the axis P via the pins 526 and causes blocking end 524 to move in a second direction, as indicated by arrow C. The second direction is substantially opposite to first direction. In this position, the blocking end 524 moves out of alignment with blocking surface 512*a* into the intermediate or unlocking or operative position. The lighter 505 operates similarly to the first embodiment discussed with reference to FIGS. 1, 3, and 7.

Figure 17:
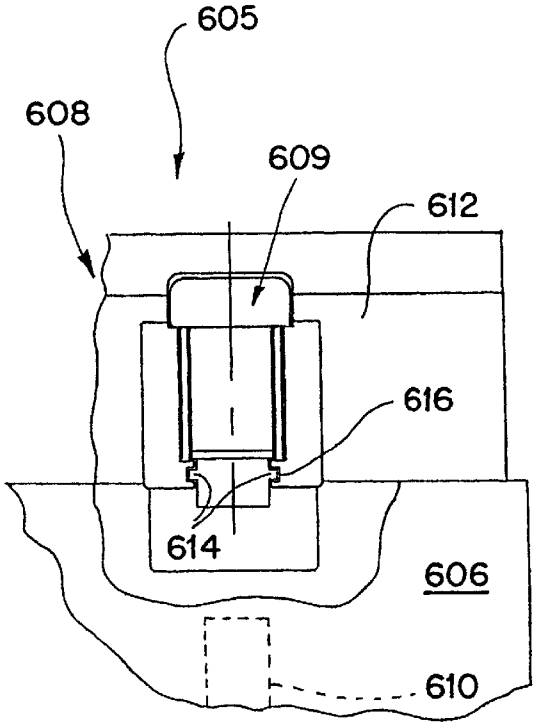
FIG. 17 is a partial, side view of another embodiment of a lighter having an actuator and a latch member formed in accordance with the present invention.

Referring to FIG. 17, a lighter 605 of another embodiment is shown. The lighter 605 includes a housing 606, an actuator 608 and a latch member 609. The housing is similar to that shown in FIG. 12 however, the blocking surface 610 (shown in phantom) is disposed on a side wall of the housing. The latch member 609 is slidably coupled to a side wall 612 of the actuator 608 via the projections 614 of the latch member and the notches 616 of the actuator. The lighter 605 operates similarly to that discussed with reference to FIGS. 11–13 except the latch is on the side rather than the rear of the actuator.

Figure 18:
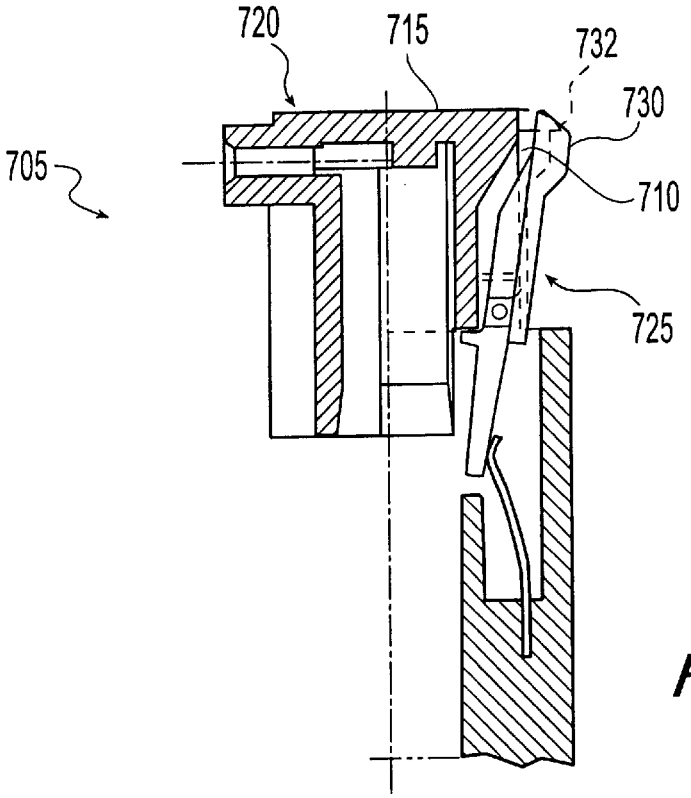
FIG. 18 is a partial, side longitudinal view, in partial cross-section of another embodiment of a lighter showing the actuator and latch member in the first or inoperative position.
Figure 19:
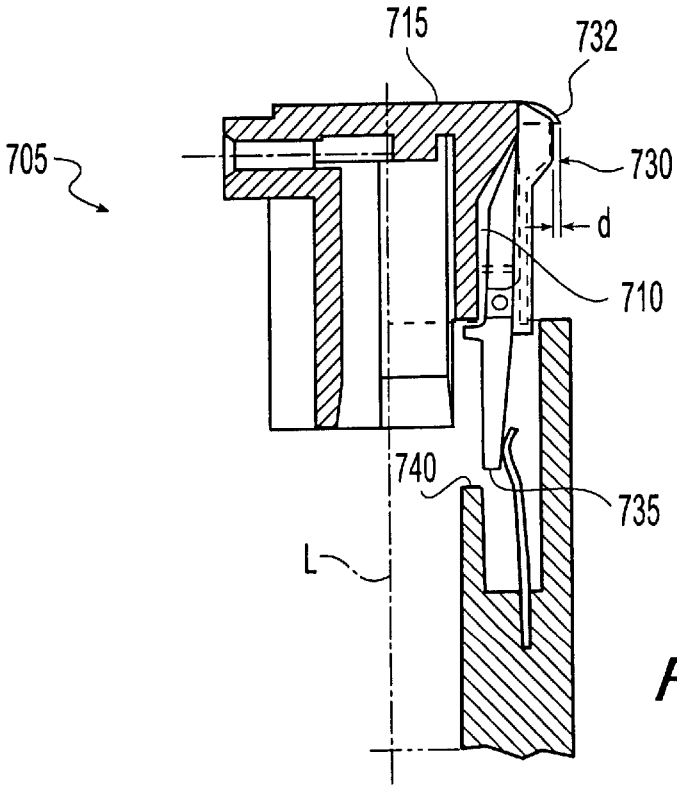
FIG. 19 is a partial, longitudinal view, in partial cross-section of the lighter similar to FIG. 18 showing the actuator and latch member in the intermediate position.

Referring to FIGS. 18–19, a lighter 705 in accordance to another embodiment is illustrated. The lighter 705 is substantially similar to the lighter 205 shown in FIG. 9, except that it has an additional feature, i.e., the cavity 710 is defined to extend through the top surface 715 of the actuator 720. As a result, the latch member 725 has a finger actuation portion 730 with a top surface that is substantially level with the top surface 715 of the actuator in the inoperative position (as shown in FIG. 18). In the first position, the finger actuation portion 730 extends rearwardly and is spaced rearwardly from the rear surface 732 of the actuator. As shown in FIG. 19, in the intermediate position, the free end 735 of the latch member is unaligned with the blocking surface 740, and optionally the finger actuation portion 730 is disposed within the cavity 710 such that finger actuation portion 730 is spaced inwardly from the rear surface 732 by a predetermined distance designated "d". The cavity 710 and latch member 725 are configured so that the pulp of an intended adult user's finger may depress the finger actuation portion the distance "d" into the intermediate position, but it is more difficult for the finger of an unintended user to depress the finger actuation portion sufficiently to reach the intermediate position. In another embodiment, the latch member 725 can be positioned on the side of the actuator. From the intermediate position illustrated in FIG. 19, the intended user may move actuator 720 along longitudinal axis L toward the actuation position.

Figure 20:
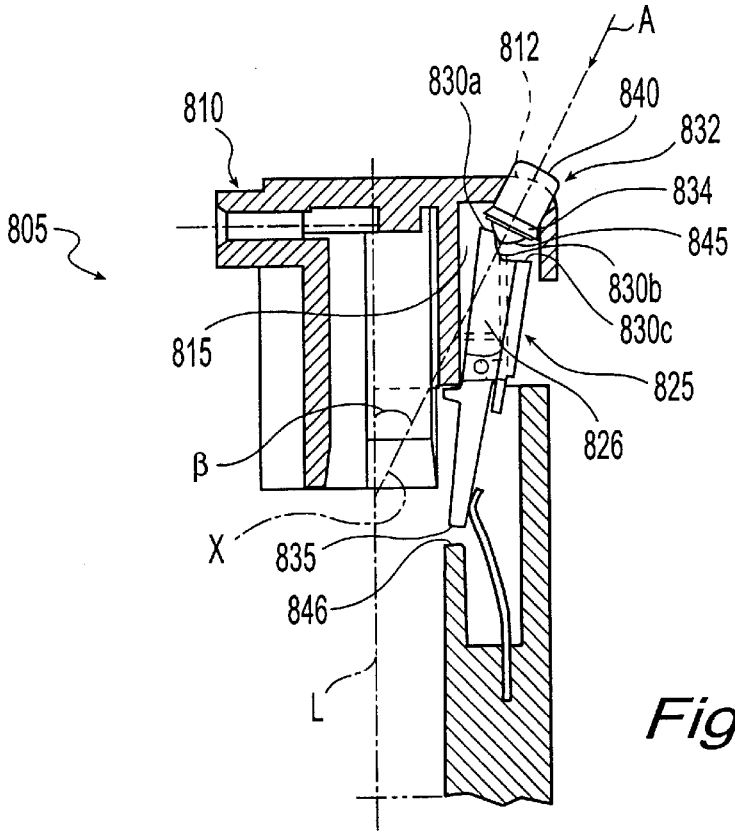
FIG. 20 is a partial, side longitudinal view, in partial cross-section of yet another embodiment of a lighter showing the actuator and latch member in the first or inoperative position.
Figure 21:
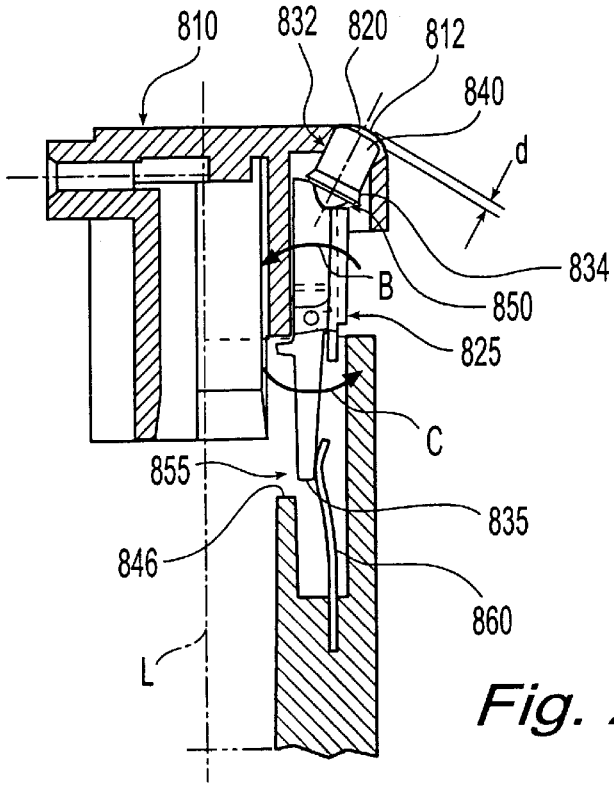
FIG. 21 is a partial, longitudinal view, in partial cross-section of the lighter similar to FIG. 20 showing the actuator and latch member in the intermediate position.

Referring to FIGS. 20–21, a lighter 805 in accordance with another embodiment is illustrated. The lighter 805 has an actuator 810 which includes an outer surface 812, an internal cavity 815, and an opening, such as a bore or a slot 820, defined through the actuator. The bore 820 is in communication with the cavity 815 and can have various cross-sectional shapes, such as square, round, rectangular, polygonal, etc.

The latch member 825 includes a body portion 826 and a separate cam member 832 slidably engaged therewith. The body portion 826 is pivotally coupled to the actuator 810 in the same manner described above. The body portion 826 includes upper cam surface portions 830*a*, 830*b*, and 830*c*. The surface portion 830*a* is the uppermost portion, surface portion 830*c* is the lowermost portion, and the substantially vertical surface portion 830*b* extends there between. The body portion 826 further includes a free end 835 opposite the cam surface portions 830*a–c*.

The cam member 832 includes a ledge 834, a finger actuation portion 840 and a lower cam surface 845 spaced from the finger actuation portion 840. Ledge 834 helps prevent the cam member 832 from exiting bore 820. The lower cam surface is preferably partially cylindrical, hemispherical or conical. However, the lower cam surface is not limited to these shapes.

As shown in FIG. 20, in the first or inoperative position the finger actuation portion 840 of the latch member extends above the outer surface 812 of the actuator. Furthermore, the cam surface 845 is disposed on the cam surface portion 830*a*, and the free end 835 of the latch member is aligned with the blocking surface 846.

When an intended user engages the finger actuation portion 840 with the pulp of his or her finger, and depresses the cam member 832 in a downward direction A, the cam surface 845 contacts and slides along the cam surface portions 830*a–c*. The actuation axis of the cam member 840 is designated X. The actuation axis X is at an angle β to the longitudinal axis L. It is preferred that the angle β is greater than 0° and less than about 90° from the axis L. More preferably, β is between about 15° to about 35° from the axis L. In the embodiment shown in FIGS. 20 and 21, the angle β is about 25° from the axis L.

During depression of the cam member 832, referring to FIG. 21, when the finger actuation portion 840 is pushed below the outer surface 812 of the actuator, the upper end 850 of the body portion 826 of latch 825 pivots in the direction of the arrow B and the lower end 855 of the body portion pivots in the opposite direction of the arrow C. As a result, the latch member 825 is in the intermediate position (as shown in FIG. 21). In the intermediate position, the top surface of finger actuation portion 840 may be pushed inwardly by the pulp of the intended adult user's finger within bore 820 by a predetermined distance "d". Bore 820 and cam member 832 are configured so that the pulp of the intended adult user can push the finger actuation portion into bore 820. Then movement in the downward direction by the finger will cause the actuator to move along the actuation axis L and ignite the lighter. When the actuator 810 and latch member 825 are released, the spring in the piezoelectric (not shown) returns the actuator to the first position, and the spring 860 biases the latch member into the first or inoperative position. Although the cam member is shown extending from the rear of the actuator, it can also be positioned to extend from the side of the actuator.

Figure 22:
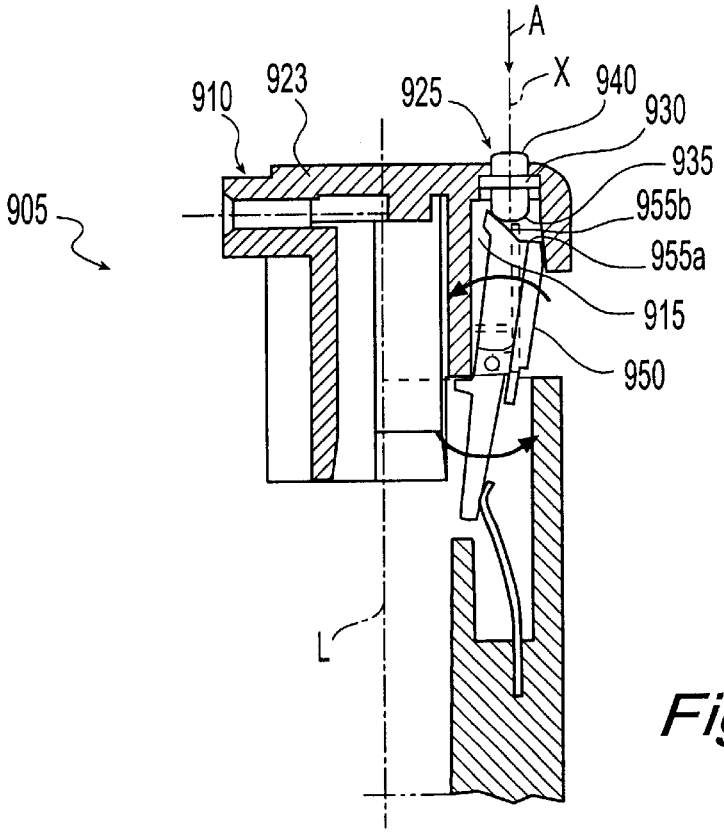
FIG. 22 is a partial, side longitudinal view, in partial cross-section of another embodiment of a lighter showing the actuator and latch member in the first or inoperative position.
Figure 23:
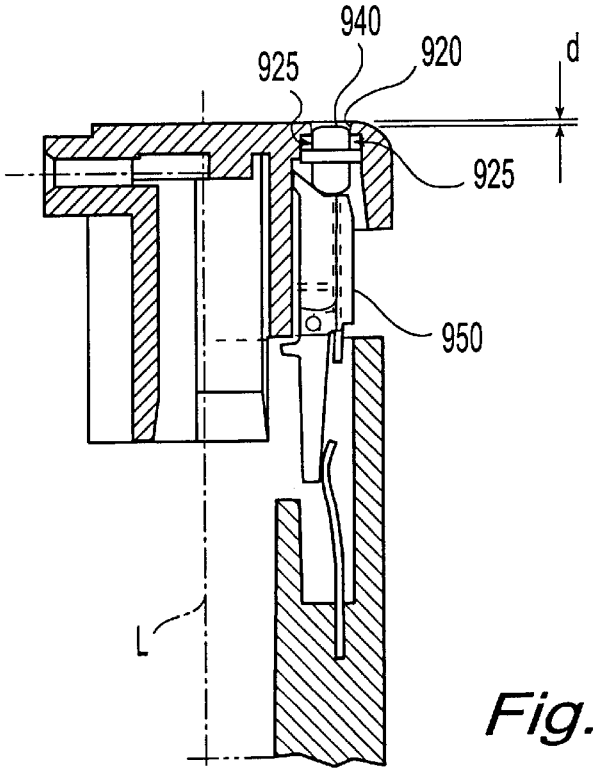
FIG. 23 is a partial, longitudinal view, in partial cross-section of the lighter similar to FIG. 22 showing the actuator and latch member in the intermediate position.

Referring to FIGS. 22 and 23, another embodiment of a lighter 905 is illustrated. The lighter 905 is substantially similar to the lighter 805 shown in FIG. 21, except that the angle β is shown to be substantially 0°. In other words, the actuator 910 includes a cavity 915, and opening, such as a bore or slot 920, where the bore is disposed through the top wall 923 of the actuator. As a result, the actuation axis X of the cam member 925 is substantially parallel to the axis L. The cam member 925 includes a circumferentially extending ledge 930 between the lower cam surface 935 and the finger actuation portion 940. The ledge 930 helps prevent the cam member from exiting the bore 920.

The body portion 950 includes an upper cam surface portions 955*a* and 955*b* which are angularly offset from one another. In the first or inoperative position, the cam member 925 is in contact with the cam surface portion 955*b*. When the cam member 925 is depressed in the direction A, the lower cam surface 935 moves along the cam surface portion 955*b* to the cam surface portion 955*a* and causes the body portion 950 to pivot into the intermediate or operative position (as shown in FIG. 23) allowing the movement of actuator 910 along the axis L to the actuation position. As shown in FIG. 23, in the intermediate position, the top surface of finger actuation portion 940 may be pushed inwardly by the pulp of the intended adult user's finger within bore 920 by a predetermined distance "d". Bore 920 and cam member 925 arc sized and dimensioned such that the pulp of the intended adult user can push the finger actuation portion 940 into bore 920. In another embodiment, the cam member can be positioned to extend through the top wall of the actuator at any other locations on the top wall.

Figure 24:
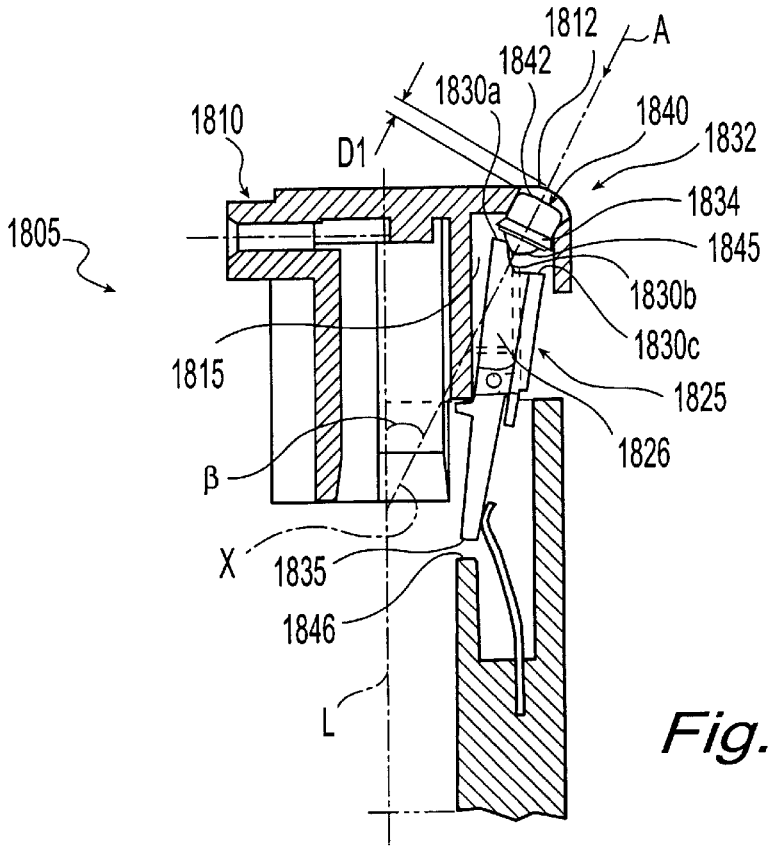
FIG. 24 is a partial, side longitudinal view, in partial cross-section of yet another embodiment of a lighter showing the actuator and latch member in the first or inoperative position.
Figure 25:
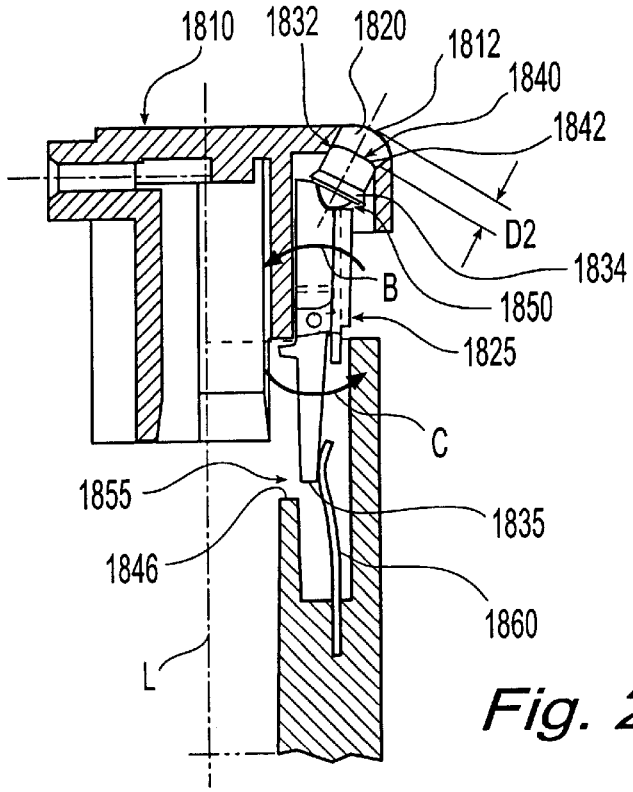
FIG. 25 is a partial, longitudinal view, in partial cross-section of the lighter similar to FIG. 24 showing the actuator and latch member in the intermediate position.
Figure 14:
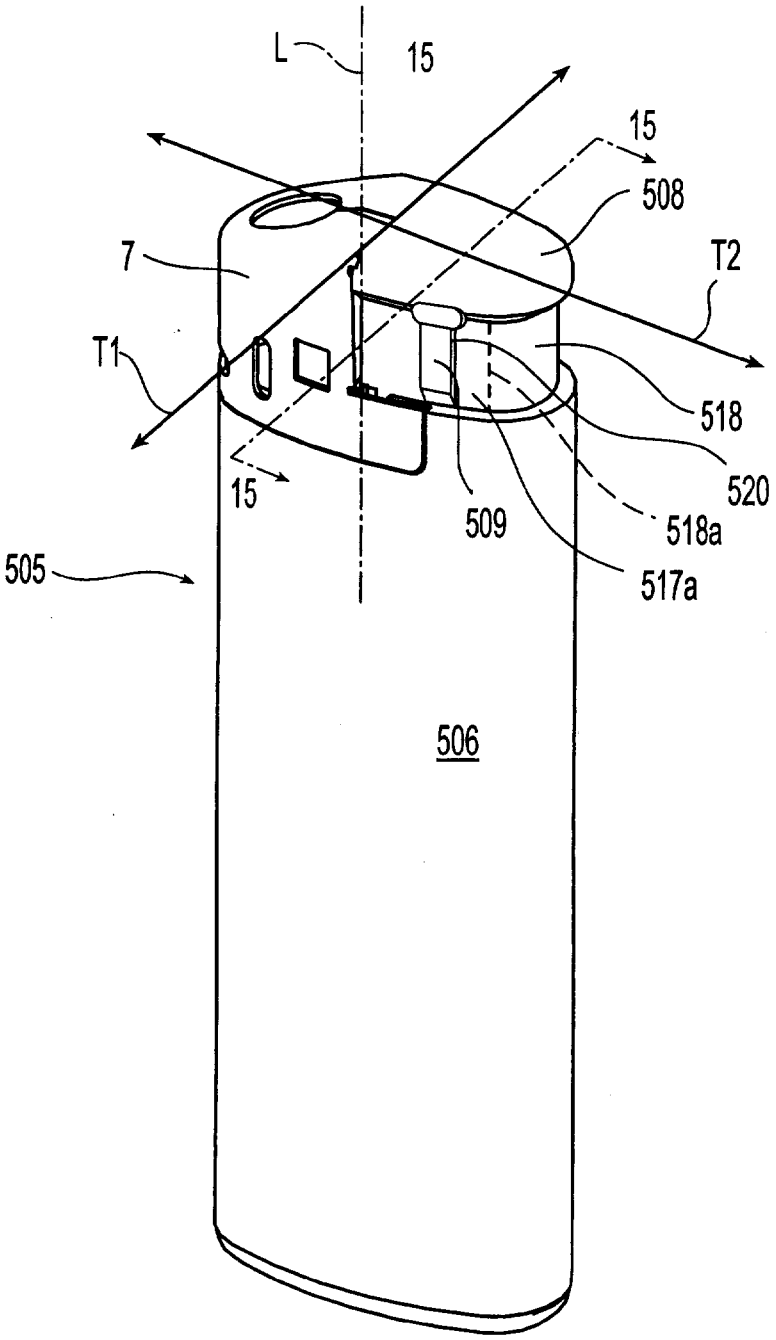

Referring to FIGS. 24–25, another embodiment of a lighter 1805 is illustrated. The lighter 1805 is substantially similar to the lighter 805 shown in FIG. 20. Actuator 1810 includes an outer surface 1812, an internal cavity 1815 and an opening, Such as bore or slot 1820, is defined through the actuator. The bore 1820 is in communication with the cavity 1815.

The latch member 1825 includes a body portion 1826 and a separate cam member 1832 slidably engaged therewith. The body portion 1826 is pivotally coupled to the actuator 1810 in the same manner described above. The body portion 1826 includes upper cam surface portions 1830*a*, 1830*b*, and 1830*c*. The surface portion 1830*a* is the uppermost portion, surface portion 1830*c* is the lowermost portion, and the substantially vertical surface portion 1830*b* extends there between. The body portion further includes a free end 1835 opposite the cam surface portions 1830*a–c*.

The cam member 1832 includes a ledge 1834, a finger actuation portion 1840 with an upper surface 1842, and a lower cam surface 1845 spaced from the finger actuation portion 1840. The ledge 1834 prevents the cam member from exiting bore 1820

As shown in FIG. 24, in the first or inoperative position the cam member 1832 of the latch member extends below the outer surface 1812 of the actuator so that the upper surface 1842 is spaced a first distance D1 beneath the outer surface 1812. Furthermore, the cam surface 1845 is disposed on the cam surface portion 1830*a*, and the free end 1835 of the latch member is aligned with the blocking surface 1846.

When an intended user engages the finger actuation portion 1840 with the pulp of his or her finger, and depresses the cam member 1832 in a downward direction A, the cam surface 1845 contacts and slides along the cam surface portions 1830*a–c*. The actuation axis of the cam member 1840 is designated X. The actuation axis X is similarly defined as discussed above with respect to FIGS. 20–21.

During depression of the cam member 1832, referring to FIG. 25, the top surface 1842 of the finger actuation portion 1840 may be pushed inwardly by the pulp of the intended adult user's finger within bore 1820 a second distance D2 beneath the outer surface 1812 of the actuator. The upper end 1850 of the body portion pivots in the direction of the arrow B and the lower end 1855 of the body portion pivots in the opposite direction of the arrow C. As a result, the latch member 1825 is in the intermediate position (as shown in FIG. 24). Bore 1820 and cam member 1832 are configured so that the pulp of the intended adult user can push the finger actuation portion deeper into bore 1820 than in the first position. In the intermediate position, the second distance D2 is greater than the first distance D1.

Then movement in the downward direction by the finger will cause the actuator to move along the actuation axis L and ignite the lighter. When the actuator 1810 and latch member 1825 are released, the spring in the piezoelectric (not shown) returns the actuator to the first position, and the spring 1860 biases the latch member into the first or inoperative position. Although the cam member is shown extending from the rear of the actuator, it can also be positioned to extend from the side of the actuator.

In all of the embodiments above, the finger can make uninterrupted contact with the finger actuation portion of the latch member from movement of the latch member the first or inoperative position to the operative or intermediate position and movement of the actuator from the first position to an actuation position. In the intermediate position, the latch member is unaligned with the blocking surface on the lighter body, and the actuator is in its first position and can be moved to the actuation positioned. Furthermore, also applicable to all embodiments the latch member is actuatable by a portion of the pulp of the fingers of intended adult users.

While it is apparent that the invention herein disclosed is well calculated to fulfill the objects above stated, it will be appreciated that modifications and embodiments may be devised by those skilled in the art. One such modification includes changing the biasing element to another element that biases the latch member into the inoperative position. For example, resilient material, such as foam can be used, a metal coil spring, a plastic spring leg integrally formed with the latch member, or the like can also be used. Another modification includes pivotally coupling the latch member to the actuator in a number of ways including using pivot members with cam surfaces, overhangs with cam surfaces, and bores cooperating with pins as disclosed in U.S. patent application Ser. No. 09/172,609, filed Oct. 15, 1998, entitled "Child Resistant Lighter" which is expressly incorporated by reference herein in its entirety. The embodiments above can also be modified so that some features of one embodiment are used with the features of another embodiment. In addition, the latch member can include cutouts and the actuator can include pins for allowing pivoting of the latch member. Other pivotal connections, such as projections with cam surfaces can also be used. Furthermore, the actuator and the housing can be configured so that the actuator slides along the longitudinal axis L within the housing without the guide of the embodiment above. It is intended that the appended claims cover all such modifications and embodiments as fall within the true spirit and scope of the present invention.

What is claimed is:

1. A lighter comprising:

a housing having a fuel supply and a blocking surface;

a valve for supplying fuel from said fuel supply;

an actuator mounted for movement with respect to said housing;

an ignition mechanism coupled to said actuator such that movement of said actuator from a first position to an actuation position causing said ignition mechanism to ignite said fuel; and a latch member having a first portion and a second portion having a free end, wherein said latch member is pivotally and non-bendably coupled to said actuator, such that in a locked position the free end of the latch member is aligned with the blocking surface, wherein movement of the first portion in a first direction causes the free end to move in a second direction opposite to the first direction and causes the free end to become unaligned with the blocking surface which permits movement of said actuator from said first position to said actuation position to actuate said ignition mechanism to ignite said fuel.

2. The lighter of claim 1, further including the latch member being pivotally coupled to a rear wall of the actuator.

3. The lighter as in claim 2, wherein the actuator further including two longitudinally extending spaced ribs extending from the rear wall, each rib defining a cutout.

4. The lighter as in claim 3, wherein the latch member further includes transversely extending pins being disposed within the cutouts for allowing the pivoting of the latch member.

5. The lighter as in claim 1, wherein the first direction is forward and the second direction is rearward.

6. The lighter as in claim 1, wherein the free end in the locked position is forward of the free end when in an intermediate position.

7. The lighter as in claim 1, wherein the housing further includes an outer wall and a spaced inner wall, and the inner wall including the blocking surface.

8. The lighter as in claim 7, wherein a chamber is defined between the outer wall and the inner wall.

9. The lighter as in claim 8, further including a biasing element for biasing the latch member into the locked position, wherein the biasing element is disposed within the chamber.

10. The lighter as in claim 9, wherein said biasing element is a leaf spring.

11. The lighter as in claim 10, wherein said leaf spring is separate from the latch member.

12. The lighter as in claim 1, further including a biasing element for biasing the latch member into the locked position.

13. The lighter as in claim 12, wherein the biasing element is a leaf spring connected to the housing.

14. The lighter as in claim 1, wherein the first portion is a finger actuation portion and the second portion is a body portion, and a user applies a first force to the finger actuation portion to move the latch member from the locked position to an intermediate position where the free end is unaligned with the blocking surface and the user applies a second force to the finger actuation portion to move the actuator along a longitudinal axis, the first force being forward and at an angle to a horizontal plane, the angle being between 0 to less than 90 to the horizontal plane.

15. The lighter as in claim 14, wherein the user applies the first and second forces by a finger.

16. The lighter as in claim 14, wherein a portion of the pulp of the finger contacts the finger actuation portion.

17. The lighter as in claim 1, wherein in the locked position a top of the latch member is spaced from the actuator.

18. The lighter of claim 1, wherein the first portion is a finger actuation portion and the second portion is a body portion, and a user's finger makes uninterrupted contact with the finger actuation portion from the movement of the latch member from the locked position to an unlocked position and movement of the actuator from the first position to the actuation position.

19. The lighter of claim 1, wherein the first portion is a finger actuation portion and the second portion is a body portion, and the body portion further includes an upper cam surface, and the latch mechanism further includes a cam member and the cam member has the finger actuation portion on the upper surface and a lower cam surface, the cam member being slidably coupled to the body portion such that the lower cam surface contacts the upper cam surface.

20. The lighter of claim 19, wherein in a locked position the finger actuation portion being below an outer surface of the actuator by a first distance and in an intermediate position the finger actuation portion being below the outer surface of the actuator by a second distance greater than the first distance.

21. The lighter of claim 19, wherein the actuator includes an internal cavity for receiving the body portion and defining an opening, the opening being in communication with the internal cavity, and the cam member being disposed within the opening.

22. The lighter of claim 21, wherein the opening extends through the rear of the actuator.

23. The lighter of claim 21, wherein the opening extends through a top wall of the actuator.

24. The lighter of claim 19, wherein in the inoperative position the finger actuation portion being above the outer surface of the actuator and in an intermediate position the finger actuation portion being below the outer surface of the actuator.

25. The lighter of claim 24, wherein a user's finger makes uninterrupted contact with the finger actuation portion from the movement of the latch member from the locked position to intermediate position and movement of the actuator from the first position to the actuation position.

26. The lighter as in claim 25, wherein a portion of the pulp of the finger makes uninterrupted contact with the finger actuation portion.

27. The lighter of claim 19, wherein in the cam member includes an actuation axis forming an angle with a longitudinal axis, the angle being between substantially 0° and about 90°.

28. The lighter of claim 1, wherein the first portion is a finger actuation portion and the second portion is a body portion, body portion being pivotally coupled to the actuator, wherein in a locked position the finger actuation portion being below an outer surface of the actuator by a first distance and in an intermediate position the finger actuation portion being below the outer surface of the actuator by a second distance greater than the first distance.

29. The lighter of claim 1, wherein the latch member is held in an operative position by the user's finger, wherein once in the operative position the free end of the latch member is unaligned with the blocking surface.

30. The lighter of claim 1, wherein the actuator is capable of being depressed at least once by a finger of a user while the latch member is in an intermediate position.

31. The lighter of claim 1, wherein the ignition mechanism further includes a longitudinal axis, and the movement of the actuator from the first position to the actuation position is along the longitudinal axis.

32. A lighter comprising:

a housing having a fuel supply and a blocking surface;

a valve for supplying fuel from said fuel supply;

an actuator mounted for movement with respect to said housing;

an ignition mechanism for igniting the fuel;

a latch member having a first portion and a second portion having a free end; and a biasing element operatively associated with the latch member, wherein said latch member is only coupled to said actuator by a pivotal connection, such that in a locked position the free end of the latch member is aligned with the blocking surface, wherein movement of the first portion in a first direction causes the free end to move in a second direction opposite to the first direction and causes the free end to become unaligned with the blocking surface which permits movement of said actuator from said first position to an actuation position, and the biasing element biases and moves the latch member into the locked position whenever the latch member is released by a user.

33. The lighter of claim 32, wherein the latch member is separate from the actuator.

34. The lighter of claim 32, wherein the ignition mechanism further includes a longitudinal axis, and the movement of the actuator from the first position to the actuation position is along the longitudinal axis.

35. A lighter comprising:

a housing having a fuel supply and a blocking surface;

a valve for supplying fuel from said fuel supply;

an actuator mounted for movement with respect to said housing;

an ignition mechanism operatively associated with the actuator, where movement of said actuator from a first position to an actuation position causing said ignition mechanism to ignite said fuel;

a latch member including a first portion having a first free end and a second portion having a second free end, wherein said latch member is pivotally coupled to said actuator, such that in a locked position the second free end of the latch member is aligned with the blocking surface, wherein movement of the first portion in a first direction causes the second free end to move in a second direction opposite to the first direction and causes the free end to become unaligned with the blocking surface in an unlocked position which permits movement of said actuator from said first position to said actuation position to actuate said ignition mechanism to ignite said fuel, and the latch member is always freely movable between the locked position and the unlocked position.

36. The lighter of claim 35, wherein the ignition mechanism further includes a longitudinal axis, and the movement of the actuator from the first position to the actuation position is along the longitudinal axis.

37. The lighter of claim 35, further including a biasing element operatively associated with the latch member, the biasing element biases and moves the latch member into the locked position whenever the latch member is released by a user.

* * * * *

UNITED STATES PATENT AND TRADEMARK OFFICE

CERTIFICATE OF CORRECTION

PATENT NO. : 6,386,860 B1
DATED : May 14, 2002
INVENTOR(S) : Adams et al.

It is certified that error appears in the above-identified patent and that said Letters Patent is hereby corrected as shown below:

Drawings,
In the Figures, substitute 14 with the figure on the attached drawing sheet.

Signed and Sealed this

Twenty-sixth Day of November, 2002

*Attest:*

*Attesting Officer*

JAMES E. ROGAN
*Director of the United States Patent and Trademark Office*